US011202941B2

(12) United States Patent
Berggren et al.

(10) Patent No.: US 11,202,941 B2
(45) Date of Patent: Dec. 21, 2021

(54) SPORT BALL AND CASING DEFINING A MAJOR CHANNEL AND A MINOR CHANNEL

(71) Applicant: NIKE, Inc., Beaverton, OR (US)

(72) Inventors: Scott Ryan Berggren, Portland, OR (US); Tal Cohen, Larchmont, NY (US); Gary W. Glahn, Rhoddodendron, OR (US); Arthur Molinari, Portland, OR (US); Todd Smith, West Linn, OR (US); Vincent F. White, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 85 days.

(21) Appl. No.: 16/450,144

(22) Filed: Jun. 24, 2019

(65) Prior Publication Data

US 2019/0308075 A1 Oct. 10, 2019

Related U.S. Application Data

(63) Continuation of application No. 15/789,076, filed on Oct. 20, 2017, now Pat. No. 10,343,026.

(60) Provisional application No. 62/411,994, filed on Oct. 24, 2016.

(51) Int. Cl.

| | |
|---|---|
| ***A63B 41/08*** | (2006.01) |
| ***A63B 45/02*** | (2006.01) |
| ***A63B 45/00*** | (2006.01) |

(52) U.S. Cl.

CPC ..... *A63B 41/08* (2013.01); *A63B 45/02* (2013.01); *A63B 45/00* (2013.01); *A63B 2209/00* (2013.01); *A63B 2243/0025* (2013.01)

(58) Field of Classification Search

CPC ..... A63B 41/08; A63B 45/02

See application file for complete search history.

(56) References Cited

U.S. PATENT DOCUMENTS

| | | | | |
|---|---|---|---|---|
| 5,228,687 | A * | 7/1993 | Luecke | A63B 43/00 273/DIG. 20 |
| 9,149,701 | B1 * | 10/2015 | Bramlette | A63B 69/0071 |
| 2007/0049432 | A1 * | 3/2007 | Junior | A63B 41/08 473/596 |

(Continued)

FOREIGN PATENT DOCUMENTS

| | | | |
|---|---|---|---|
| CN | 103747840 | A | 4/2014 |
| CN | 103781518 | A | 5/2014 |

(Continued)

*Primary Examiner* — Eugene L Kim
*Assistant Examiner* — Christopher Glenn
(74) *Attorney, Agent, or Firm* — Quinn IP Law

(57) ABSTRACT

A sport ball includes a casing that includes a plurality of joined panels and defines a cavity. The casing includes at least a first panel having (a) a first layer positioned to form a portion of an exterior surface of the sport ball, (b) a second layer disposed adjacent to the first layer, and (c) a third layer disposed adjacent to the second layer. The first panel defines a first indentation and a second indentation spaced apart from the first indentation. The first indentation has a first depth and the second indentation has a second depth that is less than the first depth. The first depth is from 0.5 times to 4 times larger than the second depth. The sport ball also includes a bladder disposed within the cavity.

14 Claims, 17 Drawing Sheets

(56) References Cited

U.S. PATENT DOCUMENTS

| | | | | |
|---|---|---|---|---|
| 2008/0108462 | A1* | 5/2008 | Krysiak | A63B 41/08 473/603 |
| 2012/0142465 | A1* | 6/2012 | Berggren | A63B 45/00 473/604 |
| 2012/0277044 | A1* | 11/2012 | Berggren | B29C 65/08 473/607 |
| 2013/0260927 | A1* | 10/2013 | Thurman | A63B 41/00 473/595 |
| 2014/0179469 | A1* | 6/2014 | Berggren | A63B 41/08 473/604 |

FOREIGN PATENT DOCUMENTS

| | | | |
|---|---|---|---|
| CN | 104168964 | A | 11/2014 |
| CN | 104203355 | A | 12/2014 |
| EP | 2287395 | A1 | 2/2011 |
| WO | 2015099186 | A1 | 3/2017 |

* cited by examiner

SPORT BALL AND CASING DEFINING A MAJOR CHANNEL AND A MINOR CHANNEL

CROSS-REFERENCE TO RELATED APPLICATIONS

This application is a continuation of U.S. patent application Ser. No. 15/789,076, filed on Oct. 20, 2017, which claims the benefit of U.S. Provisional Patent Application No. 62/411,994, filed on Oct. 24, 2016, which are both hereby incorporated by reference in their entirety.

TECHNICAL FIELD

The present teachings generally relate to a sport ball.

BACKGROUND

A variety of inflatable sport balls, such as a soccer ball, conventionally exhibit a layered structure that includes a casing, an intermediate structure, and a bladder. The casing forms an exterior portion of the sport ball and is generally formed from a plurality of durable and wear-resistant panels joined together along abutting edge areas (e.g., with stitching or adhesives). Although panel configurations may vary significantly, the casing of a traditional soccer ball includes thirty-two panels, twelve of which have a pentagonal shape and twenty of which have a hexagonal shape.

The intermediate structure forms a middle portion of the sport ball and is positioned between the casing and the bladder. Among other purposes, the intermediate structure may provide a softened feel to the sport ball, impart energy return, and restrict expansion of the bladder. In some configurations, the intermediate structure or portions of the intermediate structure may be bonded, joined, or otherwise incorporated into the casing as a backing material. In other configurations, the intermediate structure or portions of the intermediate structure may be bonded, joined, or otherwise incorporated into the bladder.

The bladder, which has an inflatable configuration, is located within the intermediate structure to provide an interior portion of the sport ball. In order to facilitate inflation (i.e., with pressurized air), the bladder generally includes a valved opening filled by a valve that extends through each of the intermediate structure and casing, thereby being accessible from an exterior of the sport ball.

It may be desirable to provide the exterior surface of a sport ball with grooves or indentations. It may also be desirable to provide such indentations in a predetermined pattern in order to provide increased performance and to facilitate manufacturing of the ball.

DESCRIPTION

Figure 1:
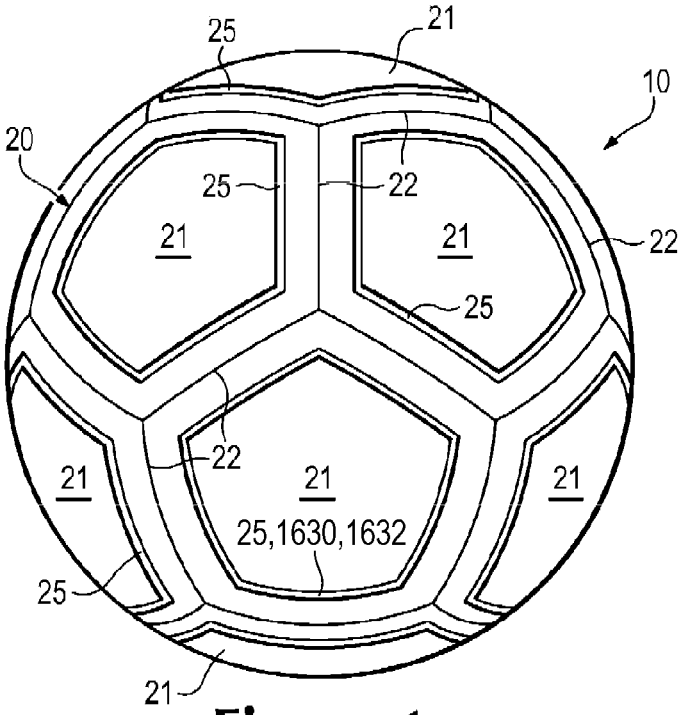
FIG. 1 is a perspective view of a sport ball.

A sport ball includes a casing including a plurality of joined panels and defines a cavity. The casing includes at least a first panel having (a) a first layer formed from a polymer material and positioned to form a portion of an exterior surface of the sport ball, (b) a second layer formed from a polymer foam material and disposed adjacent to the first layer, and (c) a third layer formed from a textile material and disposed adjacent to the second layer. The sport ball also includes a bladder disposed within the cavity. The first panel defines a first indentation and a second indentation spaced apart from the first indentation. The first indentation has a first depth and the second indentation has a second depth that is less than the first depth. The first depth is from 0.5 times to 4 times larger than the second depth.

In an embodiment, the first panel further may define a third indentation that intersects the second indentation. The third indentation may have a third depth that is equal to the first depth. In one embodiment, the third indentation may intersect the first indentation.

The first layer may be bonded directly to the third layer at at least one of the first indentation and the second indentation. Alternatively, the first layer may be spaced apart from the third layer at at least one of the first indentation and the second indentation.

In one embodiment, the first panel may have an edge and at least one of the first indentation and the second indentation may be spaced apart from the edge. In another embodiment, at least one of the first indentation and the second indentation may extend to the edge.

In one embodiment, at least one of the first indentation and the second indentation may have a substantially square cross-sectional configuration. In another embodiment, at least one of the first indentation and the second indentation may have a substantially rounded cross-sectional configuration. In one embodiment, the first panel may have a thickness and the first layer may extend through an entirety of the thickness at the first indentation and the second indentation. In another embodiment, the first layer may extend to an approximate midpoint of the thickness at the first indentation and the second indentation.

In another embodiment, the first panel defines a plurality of first indentations and a plurality of second indentations each spaced apart from at least one of the plurality of first indentations. Each of the plurality of first indentations has a first depth, and each of the plurality of second indentations has a second depth that is less than the first depth. The first depth is from 0.5 times to 4 times larger than the second depth.

The first panel may define a greater number of the plurality of second indentations than the plurality of first indentations. In an embodiment, each of the plurality of first indentations may be substantially parallel to at least another of the plurality of first indentations.

Further, in one embodiment, the first panel may have a central portion and each of the plurality of second indentations may extend radially from the central portion. One of the plurality of second indentations may have three prongs that each extend from the central portion.

In a further embodiment, one of the plurality of second indentations may be disposed between two adjacent ones of the plurality of first indentations such that the plurality of first indentations and the plurality of second indentations are disposed in an alternating arrangement.

In one embodiment, at least one of the polymer material of the first layer and the polymer foam material of the second layer may include a thermoplastic polymer material. In another embodiment, the casing may include four joined panels each having nine edges.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., may be used descriptively relative to the figures, without representing limitations on the scope of the disclosure, as defined by the claims.

The above features and advantages and other features and advantages of the present teachings are readily apparent from the following detailed description of the modes for carrying out the present teachings when taken in connection with the accompanying drawings.

The following discussion and accompanying figures disclose various sport ball configurations and methods relating to manufacturing of the sport balls. Although the sport ball is discussed and depicted in relation to a soccer ball, concepts associated with the configurations and methods may be applied to various types of inflatable sport balls. In addition to soccer balls, therefore, concepts discussed herein may be incorporated into basketballs, footballs (for either American football or rugby), volleyballs, and water polo balls, for example. A variety of non-inflatable sport balls, such as baseballs and softballs, may also incorporate concepts discussed herein.

For purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material, e.g., a thermoplastic polymer material, within at least one of the elements such that the materials of the elements are secured to each other when cooled.

As examples, welding may involve (a) the melting or softening of two panels that include polymer materials such that the polymer materials from each panel intermingle with each other (e.g., diffuse across a boundary layer between the polymer materials) and are secured together when cooled and (b) the melting or softening a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Welding may occur when only one panel includes a polymer material or when both panels include polymer materials. Welding generally produces a heat affected zone in which the materials of the two joined components are intermingled. For purposes of this disclosure, this heat affected zone shall be considered a "weld" or "thermal bond".

Additionally, welding does not generally involve the use of stitching or adhesives, but involves directly bonding components to each other with heat. In some situations, however, stitching or adhesives may be utilized to supplement the joining of components through welding.

In some embodiments, sport ball casings may be formed of a plurality of panels. The panels may be joined to each other using welding to form the seams between the casing panels. As with traditional stitching of sport ball panels, the peripheral edges of the panels may be folded to form flange portions. The flange portions of adjacent panels may be welded to one another in a similar position as panels of a sewn ball casing. The majority of the seams may be formed by welding the panels to one another, forming the casing inside out. Once the majority of the seams are welded, the casing may be turned right side out through an opening between two or more panels that are not joined together. After the casing has been turned right side out, additional components may be inserted into the casing. For example a bladder configured to retain a pressurized gas may be inserted into the casing. In addition, an intermediate layer having a limited degree of stretch may be inserted between the bladder and the casing. General procedures for manufacturing a sport ball with welded seams may be performed as disclosed in Raynak et al., U.S. Patent Application Publication No. 2010/0240479, published on Sep. 23, 2010, and entitled "Sport Ball Casing and Methods of Making the Casing," the entire disclosure of which is incorporated herein by reference.

One advantage of utilizing a welding process to form the seams relates to the overall mass of the ball. Whereas approximately ten to fifteen percent of the mass of a conventional sport ball may be from the seams between panels, welding casing panels to one another to form the seams may reduce the mass by eliminating stitching and/or adhesives from the seam. The mass that would otherwise be imparted by the stitching and/or adhesives may be utilized for other structural elements that enhance the performance properties (e.g., energy return, sphericity, mass distribution, durability, aerodynamics) of the ball. Another advantage relates to manufacturing efficiency. Stitching each of the seams of a conventional sport ball may be a relatively time-consuming process, particularly when hand stitching is utilized. By welding panels together to form the seams between panels, the time necessary for forming the casing may be reduced, thereby increasing the overall manufacturing efficiency.

In some embodiments, sport ball casing panels may include a polymer material that may be utilized to secure the panels to each other. Examples of suitable polymer materials for the casing may include thermoplastic and/or thermoset polyurethane, polyamide, polyester, polypropylene, and polyolefin. In some configurations, the casing may incorporate filaments or fibers that reinforce or strengthen the casing. In further configurations, casing 20 may have a layered structure that includes an outer layer of the polymer material and an inner layer formed from a textile, polymer foam, or other material that is with the polymer material. For example, at least one of the polymer material of the first layer and the polymer foam material of the second layer may include a thermoplastic polymer material.

When exposed to sufficient heat, the polymer materials within the casing panels transition from a solid state to either a softened state or a liquid state, particularly when a thermoplastic polymer material is utilized. When sufficiently cooled, the polymer materials then transition back from the softened state or the liquid state to the solid state. Based upon these properties of polymer materials, welding processes may be utilized to form a weld that joins peripheral portions of panels to each other.

General Sport Ball Configuration

Figure 2:
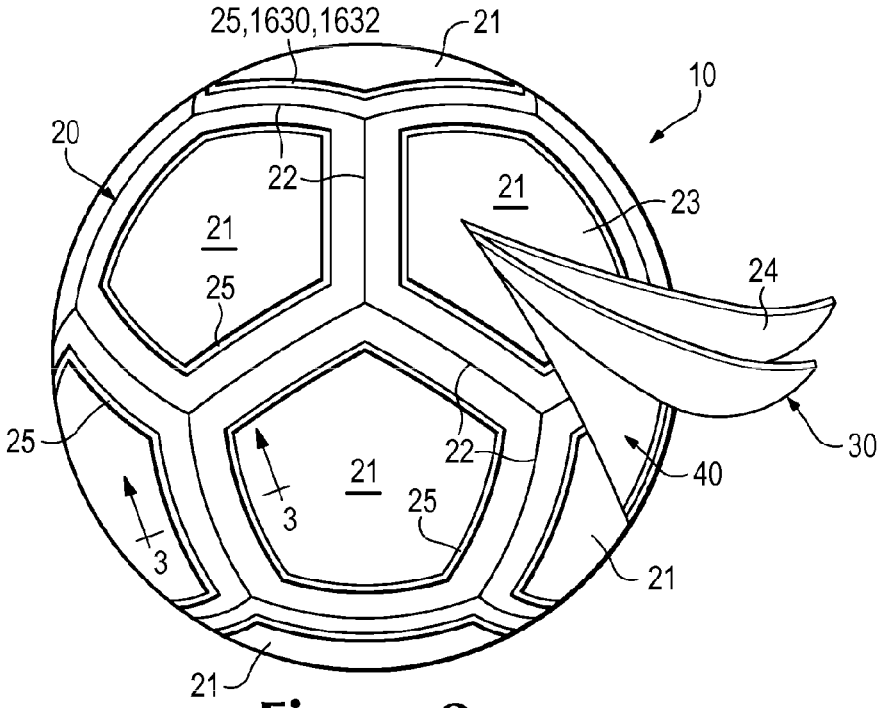
FIG. 2 is another perspective view of the sport ball.
Figure 3:
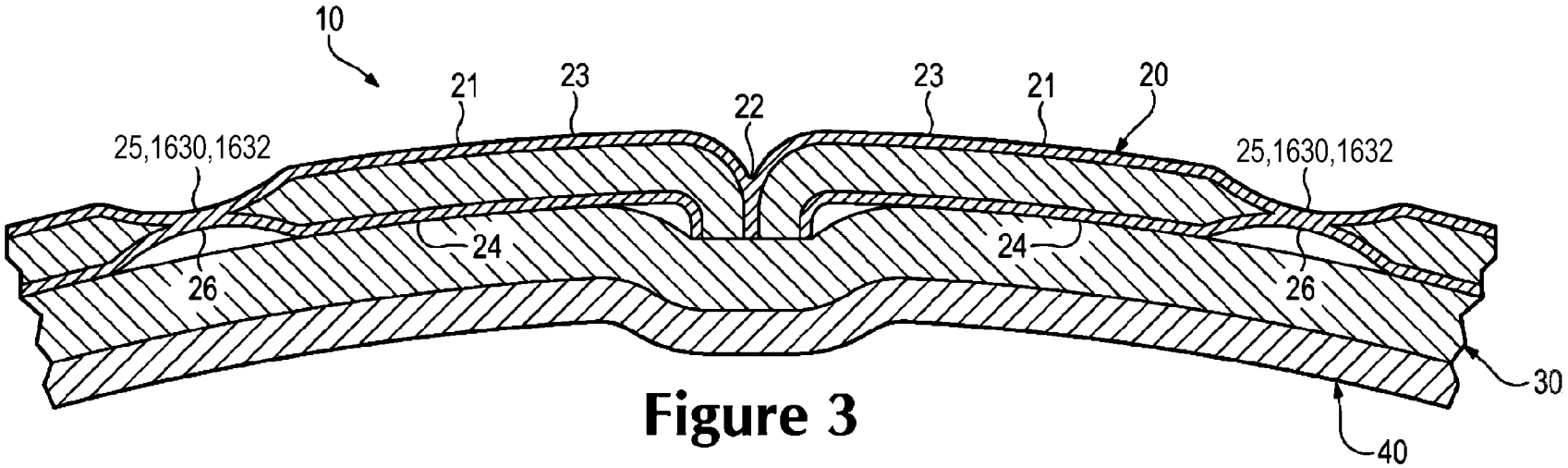
FIG. 3 is a cross-sectional view of the sport ball, as defined by section line 3 in FIG. 2.

A sport ball 10 having the general configuration of a soccer ball is depicted in FIGS. 1-3. Ball 10 exhibits a layered structure having (a) a casing 20 that forms an exterior portion of ball 10, (b) an intermediate structure 30 located within casing 20, and (c) an inflatable bladder 40 that forms an interior portion of ball 10. Upon pressurization, bladder 40 induces ball 10 to take on a substantially spherical shape. More particularly, pressure within bladder 40 causes bladder 40 to place an outward force upon intermediate structure 30. In turn, intermediate structure 30 places an outward force upon casing 20. In order to limit expansion of bladder 40 and also limit tension in casing 20, a portion of intermediate structure 30 may have a limited degree of stretch. In other words, bladder 40 places an outward force upon intermediate structure 30, but the stretch characteristics of intermediate structure 30 effectively prevent the outward force from inducing significant tension in casing 20. Accordingly, intermediate structure 30 restrains pressure from bladder 40, while permitting outward forces to induce a spherical shape in casing 20, thereby imparting a spherical shape to ball 10.

Casing 20 is formed from various panels 21 that are joined together along abutting side or edge areas to form a plurality of seams 22. Although panels 21 are depicted as having the shapes of twelve equilateral pentagons, panels 21 may have non-equilateral shapes, concave or convex edges, or a variety of other shapes (e.g., triangular, square, rectangular, hexagonal, trapezoidal, round, oval, non-geometrical) that combine in a tessellation-type manner to form casing 20. In some configurations, ball 10 may have twelve pentagonal panels 21 and twenty hexagonal panels 21 to impart the general configuration of a traditional soccer ball. Selected panels 21 may also be formed of unitary (i.e., one piece) construction with adjacent panels 21 to form bridged panels that reduce the number of seams 22. Although seams 22 may be formed by joining the abutting edge areas of panels 21 with stitching (e.g., hand or machine stitching), seams 22 may also be formed through adhesive bonding or welding. An example of welded seams is disclosed in U.S. Patent Application Publication 2010/0240479 to Raynak, et al., which is incorporated herein by reference.

Casing 20 defines an exterior surface 23 and an opposite interior surface 24. Exterior surface 23 faces outward and forms an exterior surface of ball 10. Interior surface 24 is located opposite exterior surface 23 and faces inward and toward intermediate structure 30. In many configurations of ball 10, interior surface 24 contacts intermediate structure 30. A plurality of indentations 25 and 26 are formed in casing 20 and extend toward a central area of casing 20, as depicted in FIGS. 1-3. Whereas indentations 25 are formed in exterior surface 23, indentations 26 are formed in interior surface 24. Indentations 25 are generally located opposite indentations 26.

Indentations 25 and 26 impart various advantages to ball 10. For example, indentations 25 may have a design or appearance that enhances the aesthetics of ball 10. In some configurations, indentations 25 may also form indicia identifying the manufacturer of ball 10 or conveying information as to the features of ball 10. Additionally, indentations 25 may enhance the aerodynamics of ball 10 or provide an individual with greater control over ball 10 during kicking, dribbling, or passing, for example.

Intermediate structure 30 is positioned between casing 20 and bladder 40 and may be formed to include one or more of a compressible foam layer that provides a softened feel to the sport ball 10, a rubber layer that imparts energy return, and a restriction layer to restrict expansion of bladder 40. The overall structure of intermediate structure 30 may vary significantly. As an example, the restriction layer may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, or (c) a plurality of generally flat or planar textile strips that are impregnated with latex and placed in an overlapping configuration around bladder 40. As another example, intermediate structure 30 may be formed as a substantially seamless and curved (e.g., hemispherical or spherical) textile, as disclosed in U.S. Patent Application Publication 2009/0325746 to Raynak, et al., which is incorporated herein by reference. In some configurations of ball 10, intermediate structure 30 or portions of intermediate structure 30 may also be bonded, joined, or otherwise incorporated into bladder 40, or intermediate structure 30 may be absent from ball 10. Accordingly, the structure of intermediate structure 30 may vary significantly to include a variety of configurations and materials. Bladder 40 has an inflatable configuration and is located within intermediate structure 30 to provide an inner portion of ball 10. When inflated, bladder 40 exhibits a rounded or generally spherical shape. In order to facilitate inflation, bladder 40 may include a valved opening filled with a valve (not depicted) that extends through intermediate structure 30 and casing 20, thereby being accessible from an exterior of ball 10, or bladder 40 may have a valveless structure that is semi-permanently inflated. Bladder 40 may be formed from a rubber or carbon latex material that substantially prevents air or other fluids within bladder 40 from diffusing to the exterior of ball 10. In addition to rubber and carbon latex, a variety of other elastomeric or otherwise stretchable materials may be utilized for bladder 40. Bladder 40 may also have a structure formed from a plurality of joined panels, as disclosed in U.S. Patent Application Publication 2009/0325745 to Rapaport, et al., which is incorporated herein by reference.

Panel Configuration

Figure 4:
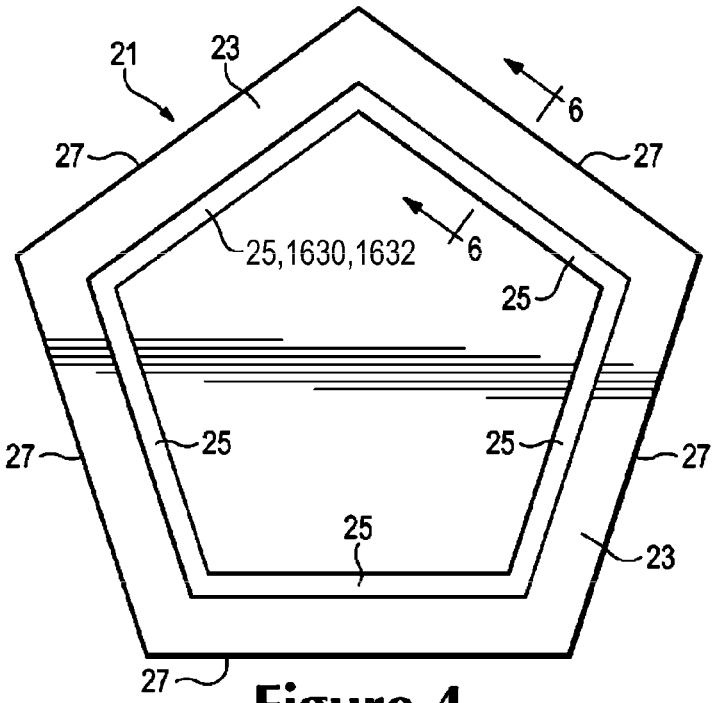
FIG. 4 is a top plan view of a panel of the sport ball.
Figure 5:
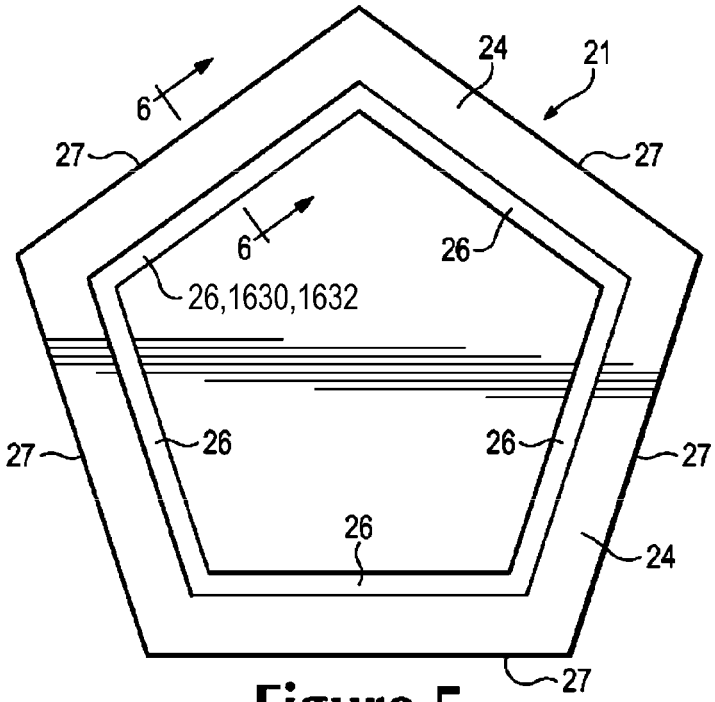
FIG. 5 is a bottom plan view of the panel.
Figure 6:
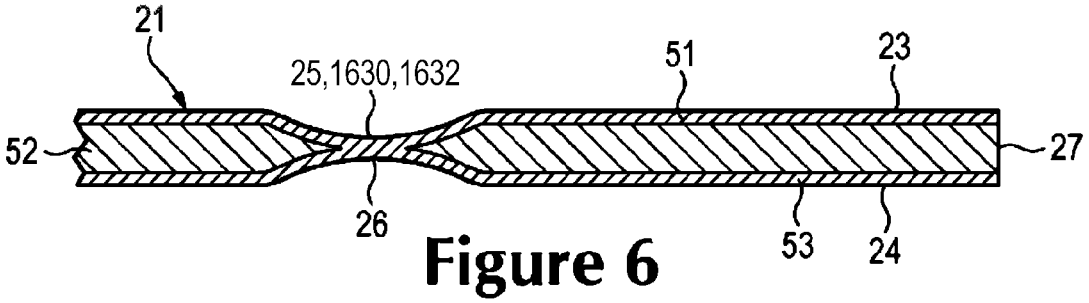
FIG. 6 is a cross-sectional view of the panel, as defined by section line 6 in FIGS. 4 and 5.

An individual panel 21 is depicted in FIGS. 4-6 and has a layered structure that includes a first or outer layer 51, a second or middle layer 52, and a third or inner layer 53. Outer layer 51 forms a portion of exterior surface 23, middle layer 52 is positioned inward and adjacent to outer layer 51, and inner layer 53 is positioned inward and adjacent to middle layer 52. In this configuration, middle layer 52 is positioned between layers 51 and 53. That is, layers 51 and 53 effectively form cover layers (i.e., outer and inner layers) located on opposite sides of middle layer 52.

A variety of materials may be utilized for each of layers 51-53, including various polymer materials, polymer foam materials, and textiles. More particularly, outer layer 51 may be formed from polymer materials that impart a durable and wear-resistant exterior surface for ball 10. Examples of suitable polymer materials for panels 21 include polyurethane, polyvinylchloride, polyamide, polyester, polypropylene, and polyolefin. In some configurations, outer layer 51 may be formed from a synthetic leather material. Middle layer 52 may be formed from a polymer foam material, such as polyurethane or ethylvinylacetate. In some configurations, middle layer 52 may include layers (e.g., three layers) of polymer foam material having different densities. Additionally, inner layer 53 may be formed from a textile material (e.g., a woven or knit textile). More particularly, the textile material of inner layer 53 may formed from polyester, cotton, nylon, rayon, silk, spandex, or a variety of other materials. The textile material may also include multiple materials, such as a polyester and cotton blend. In some configurations, one or more layers 51-53 may incorporate filaments or fibers that reinforce or strengthen casing 20. Layers 51 and 53 are generally spaced from each other by middle layer 52. In the areas of indentations 25 and 26, however, layers 51 and 53 bow inward and are bonded or otherwise secured to each other. That is, indentations 25 and 26 are located opposite each other and extend into panel 21 at corresponding locations, where the portions of layers 51 and 53 that respectively form indentations 25 and 26 are secured to each other. Whereas a majority of outer layer 51 is spaced from inner layer 53, layers 51 and 53 extend through middle layer 52 in the areas of indentations 25 and 26 to bond or otherwise be secured to each other. As such, middle layer 52 may part, form an aperture, or otherwise be absent in the areas of indentations 25 and 26. In some configurations, middle layer 52 may compress significantly in the areas of indentations 25 and 26, thereby forming a polymer layer that separates the portions of layers 51 and 53 that form indentations 25 and 26.

Figure 7A:
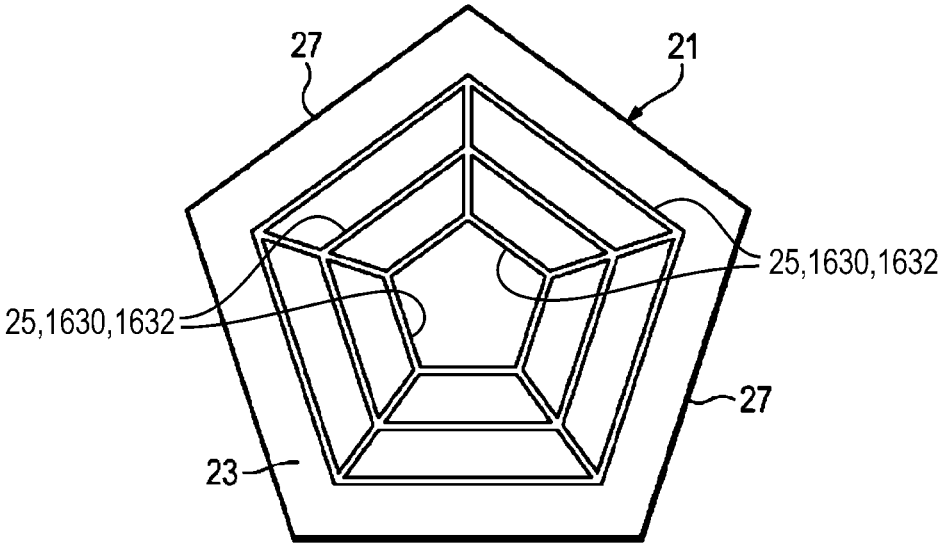
FIG. 7A is a top plan view corresponding with FIG. 4 and depicting a first configurations of the panel.
Figure 7B:
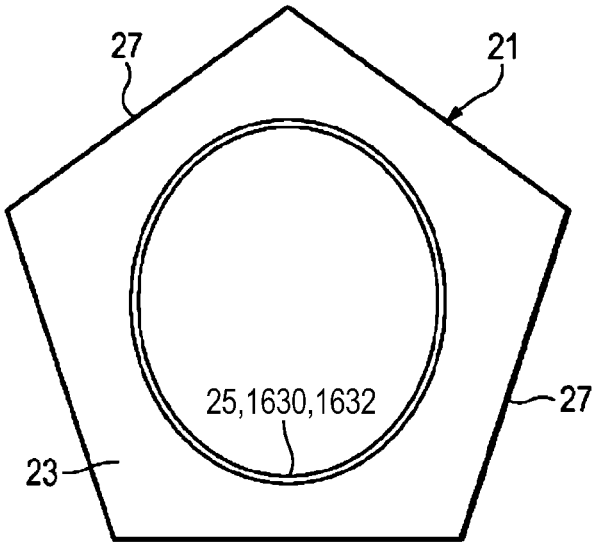
FIG. 7B is a top plan view corresponding with FIG. 4 and depicting a second configuration of the panel.
Figure 7C:
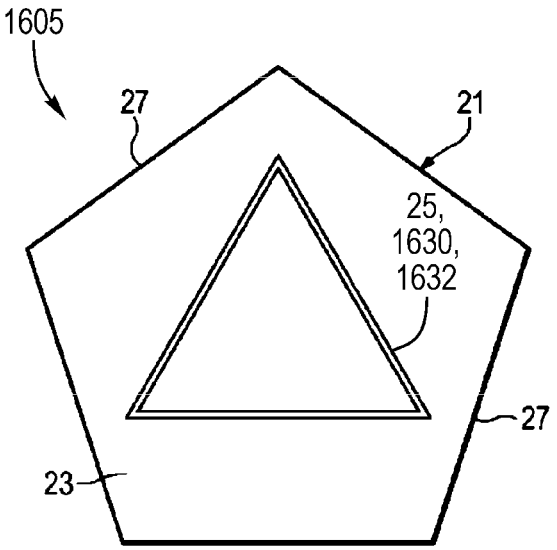
FIG. 7C is a top plan view corresponding with FIG. 4 and depicting a third configuration of the panel.
Figure 7D:
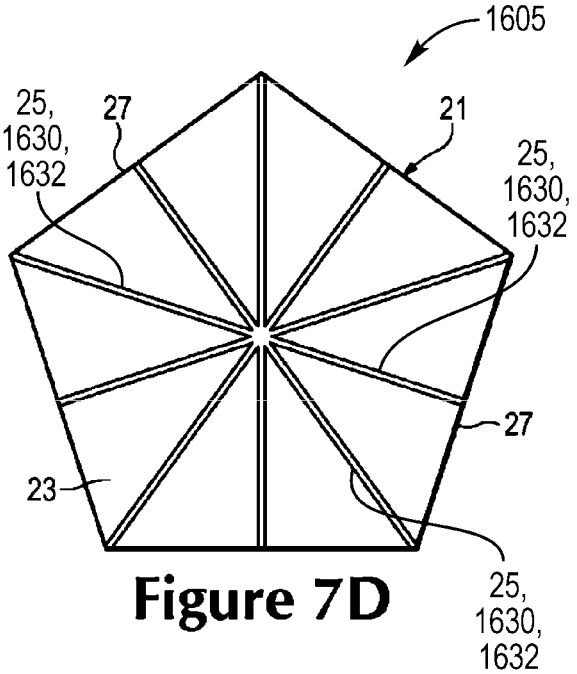
FIG. 7D is a top plan view corresponding with FIG. 4 and depicting a fourth configuration of the panel.
Figure 7E:
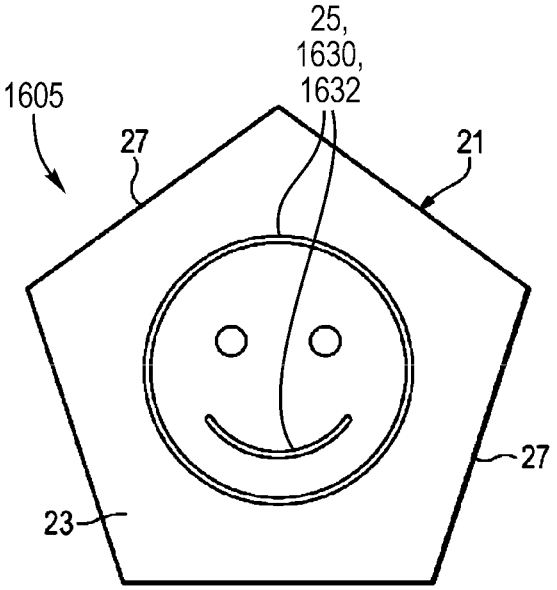
FIG. 7E is a top plan view corresponding with FIG. 4 and depicting a fifth configuration of the panel.
Figure 7F:
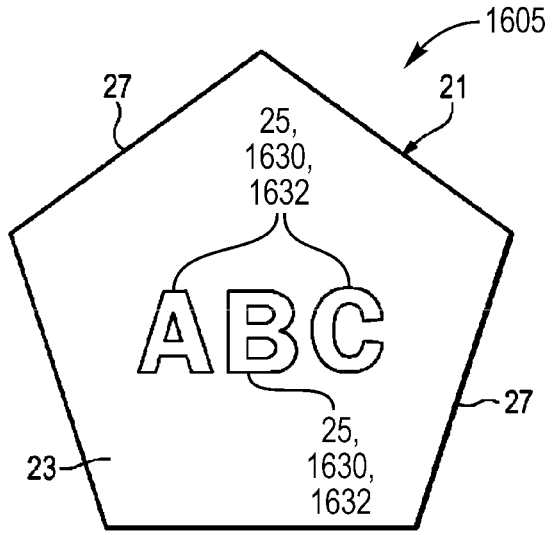
FIG. 7F is a top plan view corresponding with FIG. 4 and depicting a sixth configuration of the panel.

The positions of indentations 25 and 26 relative to panel 21 may vary considerably. As depicted, indentations 25 and 26 extend parallel to a plurality of edges 27 of panel 21. In this configuration, indentations 25 and 26 form a pentagonal shape that is spaced inward from edges 27. In further configurations of panel 21, however, indentations 25 and 26 may be located in other areas or may impart different shapes or arrangements. For example, FIG. 7A depicts a configuration wherein indentations 25 form concentric pentagons that are connected by radial portions. In FIGS. 7B and 7C, indentations 25 respectively have circular and triangular configurations, but may also be square, rectangular, hexagonal, or any other regular or non-regular shape. Referring to FIG. 7D, indentations 25 exhibit a radial configuration. In some configurations, indentations 25 may have a graphic appearance, as in FIG. 7E, or may impart information, as in FIG. 7F. Moreover, indentations 25 may also form the shape of a company logo or trademark. As discussed above, indentations 25 may have a design or appearance that enhances the aesthetics of ball 10, form indicia identifying the manufacturer of ball 10, convey information as to the features of ball 10, enhance the aerodynamics of ball 10, or provide an individual with greater control over ball 10.

These advantages may be incorporated into ball 10 by varying the shapes and arrangements of indentations 25 and 26.

In some embodiments, the indentations may be spaced from the seams of the sport ball 10. This may facilitate manufacturing by providing substantially smooth surfaces at the peripheral edges of the panels that are joined to one another. In addition, spacing the indentations from the seams may provide performance benefits, such as aerodynamics and ball feel. FIGS. 7A-7C, 7E, and 7F illustrate configurations in which indentations 25 are spaced from seams 22. (See also, FIGS. 1-5.)

In some embodiments, the indentations may extend to edges of the panels. This may facilitate manufacturing, since multiple panels may be indented simultaneously, for example, by indenting a sheet of casing material, and then cutting the sheet into a plurality of panels. This may also enable patterns to be carried across multiple panels, bridging seams between the panels. FIG. 7D illustrates a configuration in which indentations 25 extend to peripheral edges of panel 21.

Figure 8A:
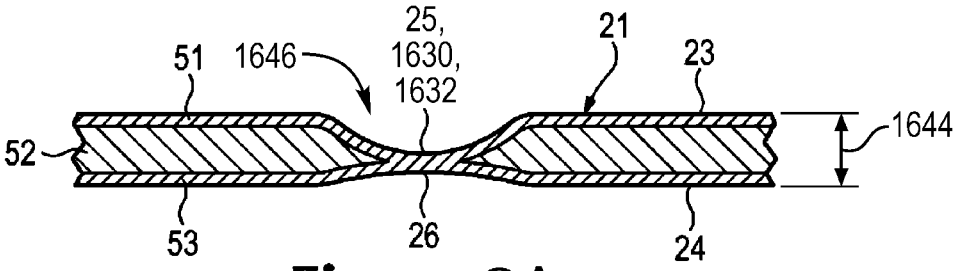
FIG. 8A is a cross-sectional view corresponding with FIG. 6 and depicting a seventh configuration of the panel.
Figure 8B:
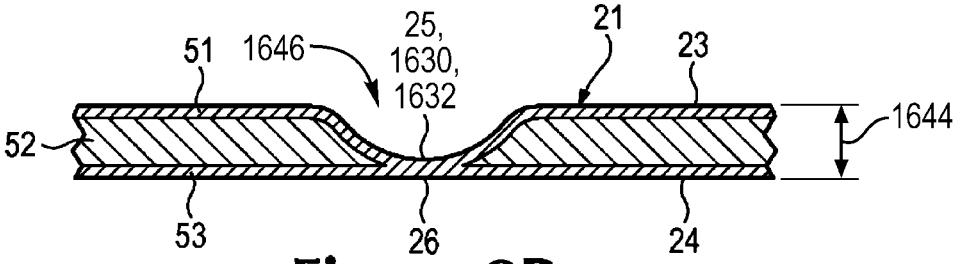
FIG. 8B is a cross-sectional view corresponding with FIG. 6 and depicting an eighth configuration of the panel.
Figure 8C:
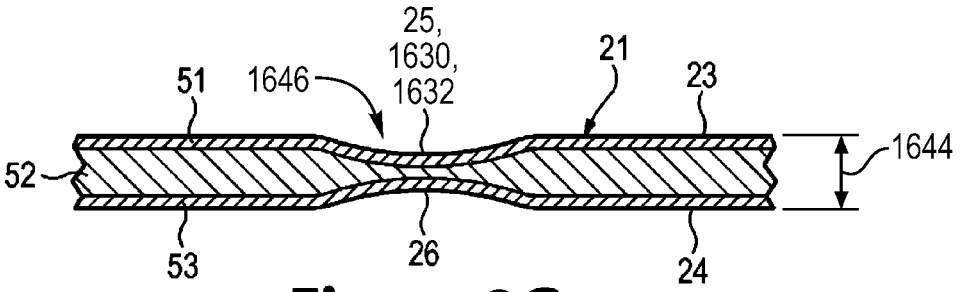
FIG. 8C is a cross-sectional view corresponding with FIG. 6 and depicting a ninth configuration of the panel.
Figure 8D:
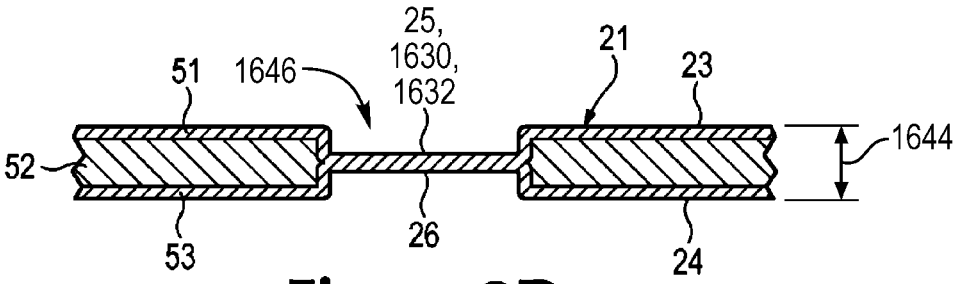
FIG. 8D is a cross-sectional view corresponding with FIG. 6 and depicting a tenth configuration of the panel.

The specific configuration of indentations 25 and 26 may also vary considerably. Referring to FIG. 6, indentations 25 and 26 each have a generally rounded configuration that extends to an approximate midpoint of panel 21. In another configuration, as depicted in FIG. 8A, indentations 25 may extend through more of the thickness of panel 21 than indentations 26. Referring to FIG. 8B, indentations 25 extend through substantially all of the thickness of panel 21. Referring to FIG. 8C, indentations 25 and 26 may be spaced from each other such that a portion of middle layer 52 extends between indentations 25 and 26. In this configuration, middle layer 52 has (a) a first thickness between indentations 25 and 26 and (b) a second thickness in an area spaced from indentations 25 and 26, the first thickness being less than the second thickness. As opposed to rounded, indentations 25 and 26 may also exhibit squared configurations, as depicted in FIG. 8D. Accordingly, indentations 25 and 26 may have various configurations.

Referring to FIG. 8C, indentations 25 and 26 may be spaced from each other such that a portion of middle layer 52 extends between indentations 25 and 26. In this configuration, middle layer 52 has (a) a first thickness between indentations 25 and 26 and (b) a second thickness in an area spaced from indentations 25 and 26, the first thickness being less than the second thickness.

As opposed to rounded, indentations 25 and 26 may also exhibit substantially squared configurations. For example, in some embodiments, the indentations may have substantially squared cross-sectional configurations. Such substantially squared cross-sectional configurations, may have a more distinct appearance than indentations having substantially rounded cross-sectional configurations. In addition, substantially squared indentations may also provide performance benefits such as aerodynamics, ball feel, and water channeling.

Figure 8E:
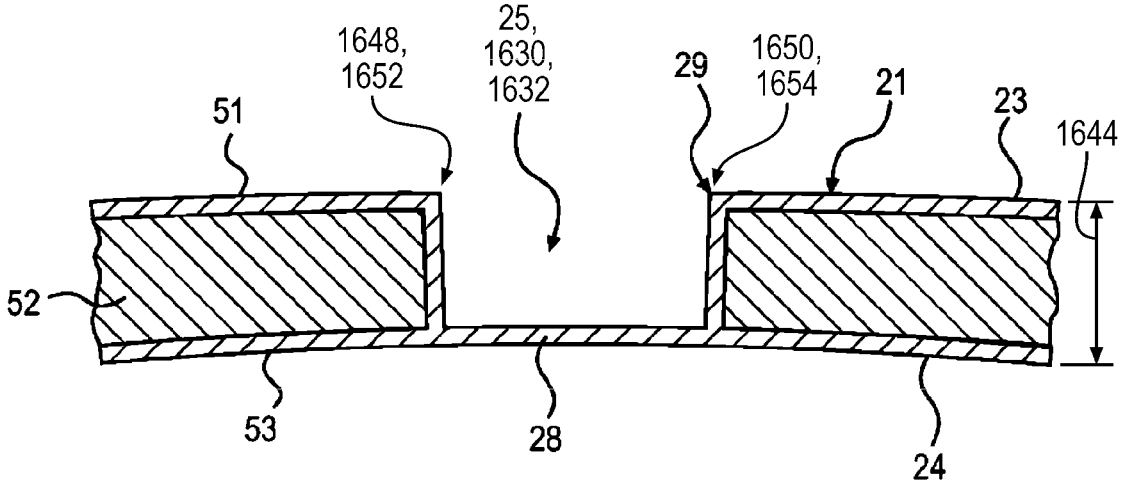
FIG. 8E is a cross-sectional view corresponding with FIG. 6 and depicting an eleventh configuration of the panel.

In some embodiments, panel 21 may include two opposing indentations having substantially squared cross-sectional configurations, as depicted in FIG. 8D. In some embodiments, panel 21 may include a substantially-squared indentation on only one side. For example, as shown in FIG. 8E, indentation 25 may extend through substantially all of a thickness of panel 21. Also, as further shown in FIG. 8E, interior surface 24 of inner layer 53 may have a substantially planar configuration opposite indentation 25 in exterior surface 23 of panel 21.

Figure 8F:
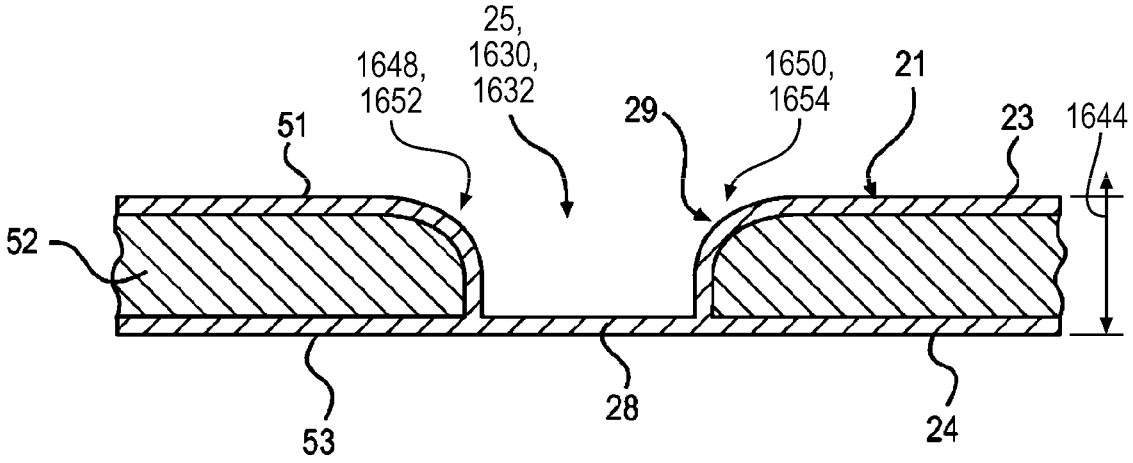
FIG. 8F is a cross-sectional view corresponding with FIG. 6 and depicting a twelfth configuration of the panel.

Accordingly, outer layer 51 may be bonded (e.g., thermal bonded) to inner layer 53 of the casing panel 21 in a bonded region 28. In some embodiments, a shoulder 29 of outer layer 51 may have a minimal radius, as shown in FIG. 8E. In other embodiments, a larger radius may be used at shoulder 29, as shown in FIG. 8F, in which indentation 25 also has a substantially squared cross-sectional configuration. The use of a minimal radius or a larger radius shoulder may be selected to facilitate manufacturing as well as for performance reasons, such as aerodynamics and ball feel.

Based upon the above discussion, panels 21 incorporate indentations 25 and 26, which may have a design or appearance that enhances the aesthetics of ball 10. In some configurations, indentations 25 may also form indicia identifying the manufacturer of ball 10 or conveying information as to the features of ball 10. Additionally, indentations 25 may enhance the aerodynamics of ball 10 or provide an individual with greater control over ball 10 during kicking, dribbling, or passing, for example.

Manufacturing Process

Figure 9A:
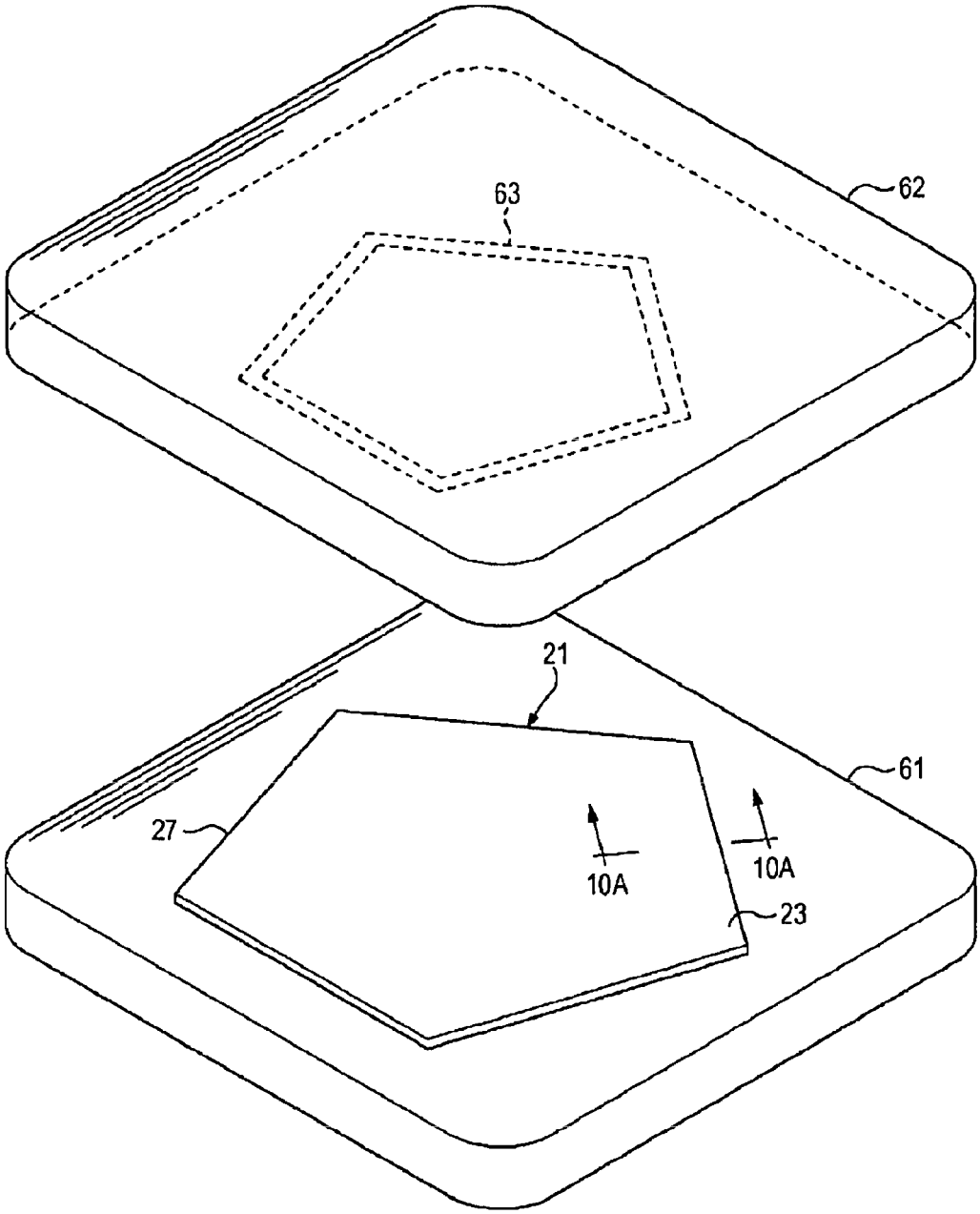
FIG. 9A is a schematic perspective view of a portion of a process for forming the panel.
Figure 9B:
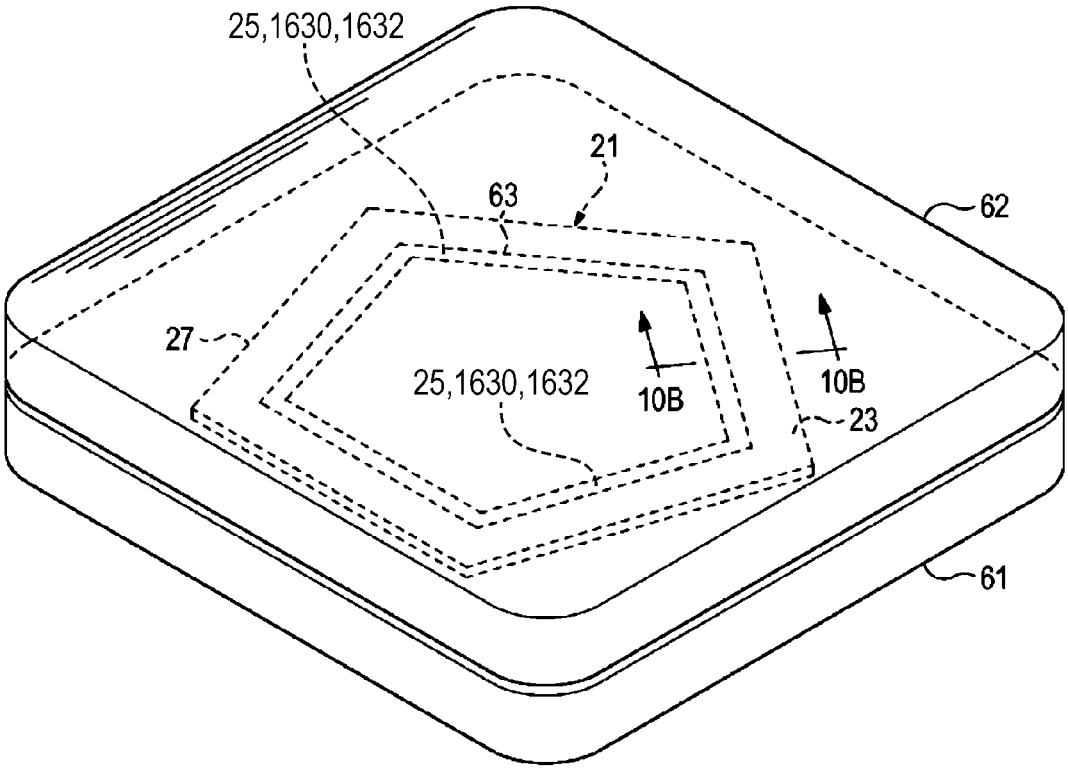
FIG. 9B is a schematic perspective view of another portion of the process for forming the panel.
Figure 9C:
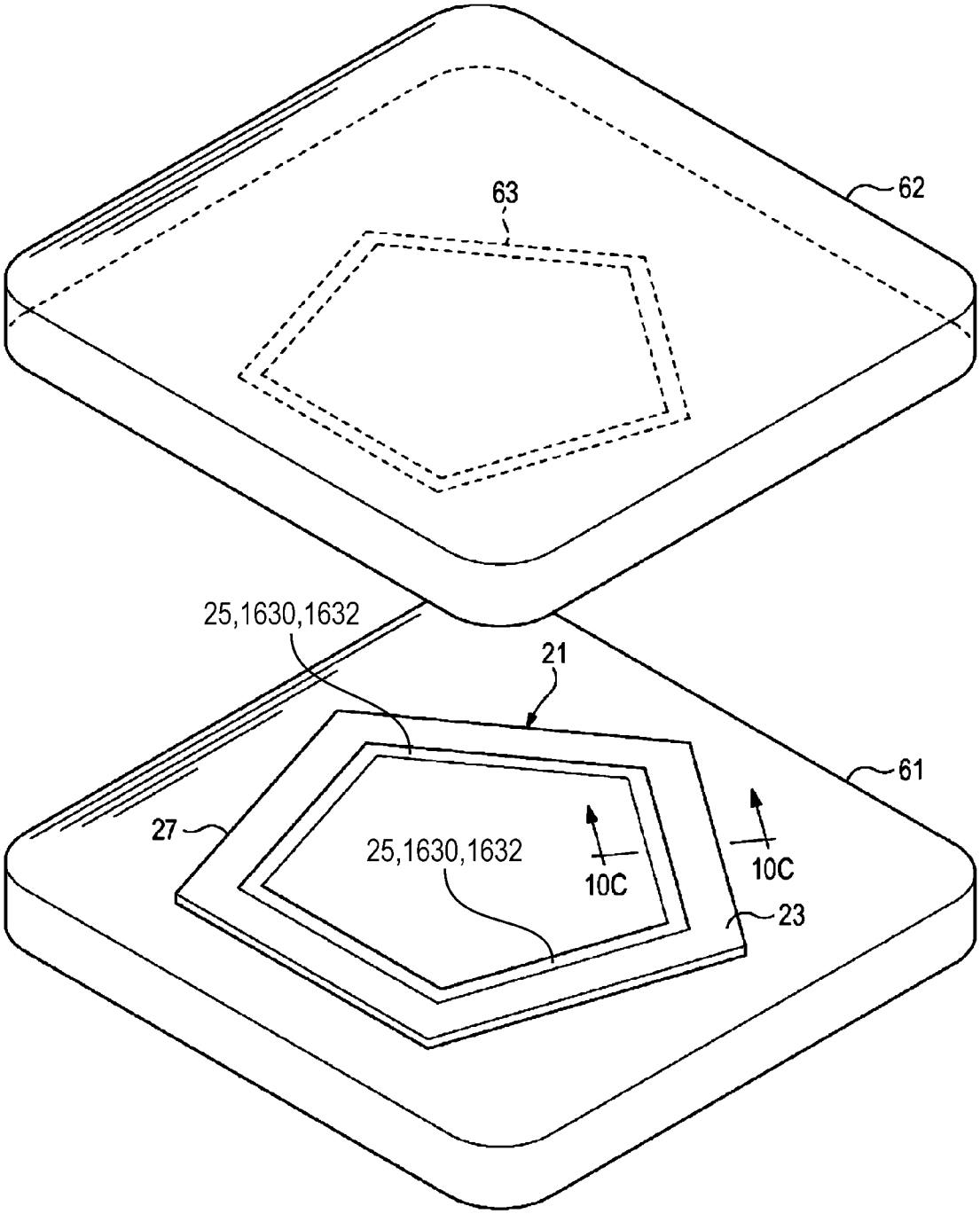
FIG. 9C is a schematic perspective view of a further portion of the process for forming the panel.
Figure 10A:
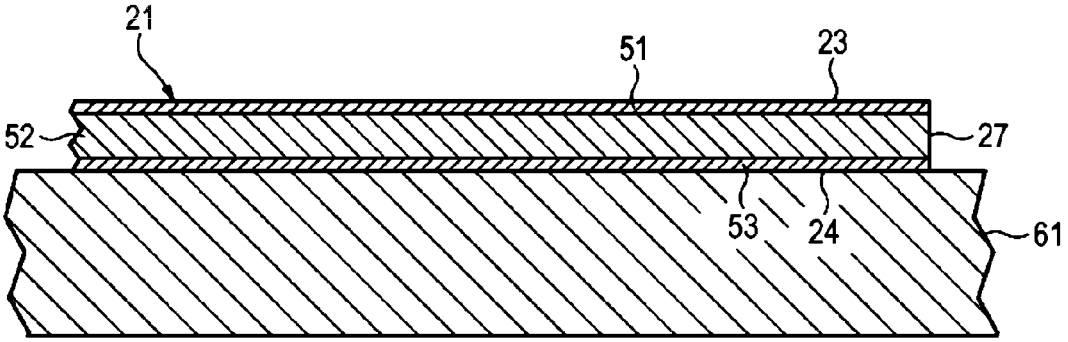
FIG. 10A is a cross-sectional view of the process for forming the panel, as defined by section line 10A-10A in FIG. 9A.
Figure 10B:
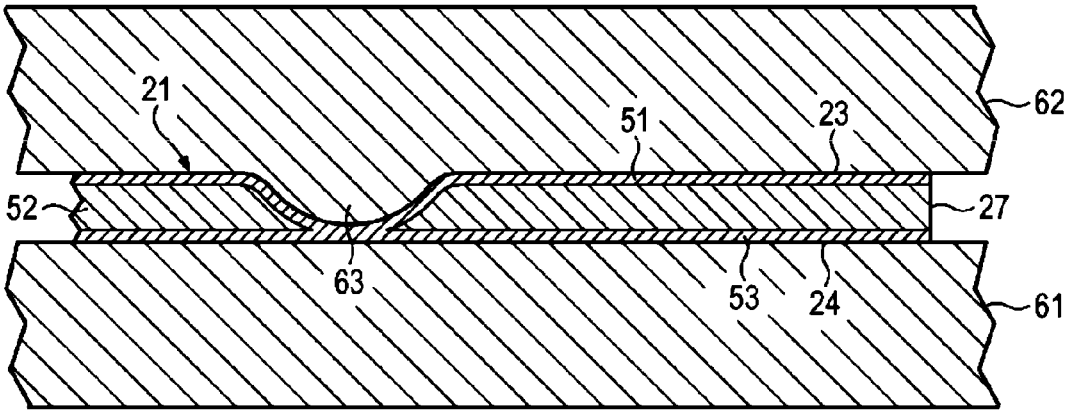
FIG. 10B is a cross-sectional view of the process for forming the panel, as defined by section line 10B-10B in FIG. 9B.
Figure 10C:
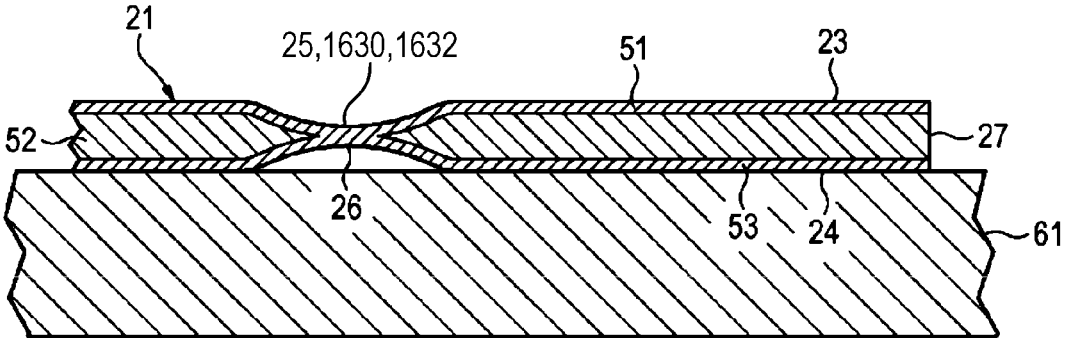
FIG. 10C is a cross-sectional view of the process for forming the panel, as defined by section line 10C-10C in FIG. 9C.

A variety of manufacturing processes may be utilized to form indentations 25 and 26 in panels 21. An example of a manufacturing process is depicted in FIGS. 9A-9C and 10A-10C. Referring to FIGS. 9A and 10A, one of panels 21 is located on a platen 61. A press plate 62 is positioned above platen 61 and includes a protrusion 63 having a pentagonal shape (e.g., a shape of indentations 25 and 26). Press plate 62 then translates toward platen 61 and compresses panel 21, as depicted in FIGS. 9B and 10B. More particularly, protrusion 63 presses into and heats the areas of panel 21 forming indentations 25 and 26. As such, press plate 62 and protrusion 63 (a) soften a portion of middle layer 52, which may be formed form a polymer foam material and (b) bond outer layer 51 to inner layer 53. As depicted in FIGS. 9C and 10C, press plate 62 then moves away from panel 21 to substantially complete the formation of indentations 25 and 26.

When exposed to sufficient heat, the polymer materials within panels 21 transition from a solid state to either a softened state or a liquid state, particularly when a thermoplastic polymer material is utilized. When sufficiently cooled, the polymer materials then transition back from the softened state or the liquid state to the solid state. Based upon these properties, (a) the polymer material of outer layer 51 may soften to form a bond with the textile material of inner layer 53 and (b) the polymer foam material of middle layer 52 may melt, soften, part, collapse, or form an aperture that permits layers 51 and 53 to contact and bond with each other.

In order to properly heat the materials within panel 21, bonding apparatus 62 may emit heat when in contact with panel 21. In some configurations, resistive heating elements may be incorporated into press plate 62 to raise the temperature of panel 21 in the areas of indentations 25 and 26. Alternately, high-frequency (HF) heating, radio frequency (RF) heating, or ultrasonic heating elements may be incorporated into press plate 62 and protrusion 63 to raise the temperature of panel 21 in the areas of indentations 25 and 26.

As an additional matter, the process disclosed above depicts protrusion 63 as pressing into one side of panel 21. That is, protrusion 63 presses into the side of panel 21 that includes outer layer 51. Although press plate 62 compresses outer layer 51 against inner layer 53, which lays against platen 61, indentation 26 forms in inner layer 53. More particularly, outer layer 51 is effectively placed in tension by the pressure from press plate 62. When the pressure from press plate 62 is removed, the tension in outer layer 51 pulls inner layer 53 toward the center of panel 21. Although protrusion 63 only presses into one side of panel 21, both indentations 25 and 26 are formed due to an equalization of forces in panel 21. Accordingly, both of indentations 25 and 26 may be formed by pressing into only one side of panel 21 with press plate 62.

Further Sport Ball Configuration

Figure 11:
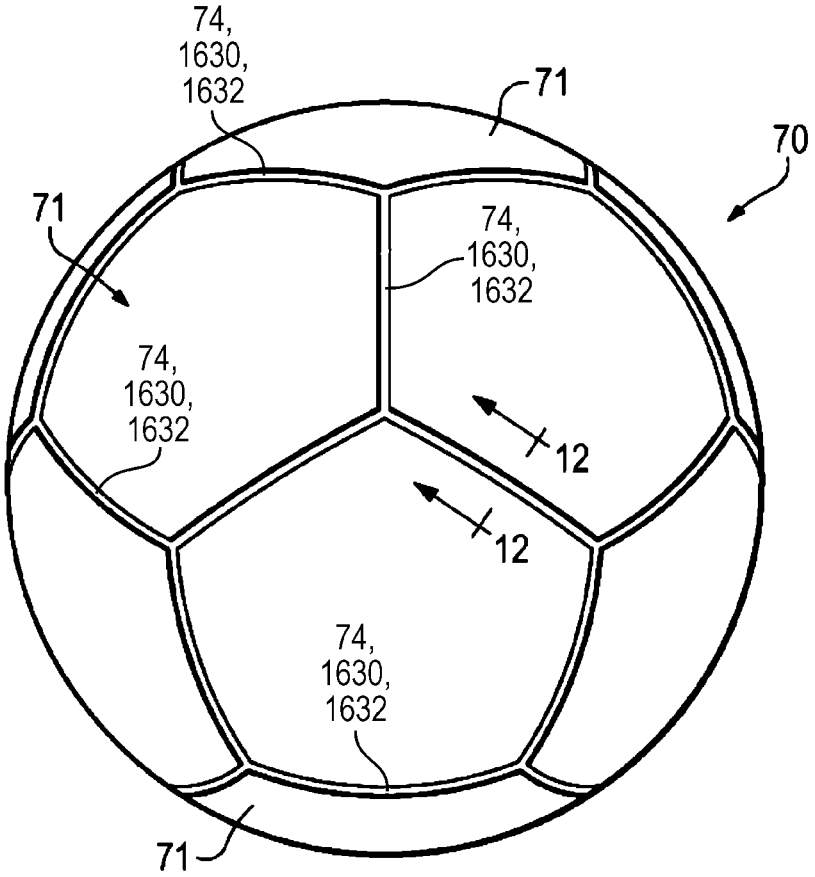
FIG. 11 is a perspective view of another sport ball.
Figure 12:
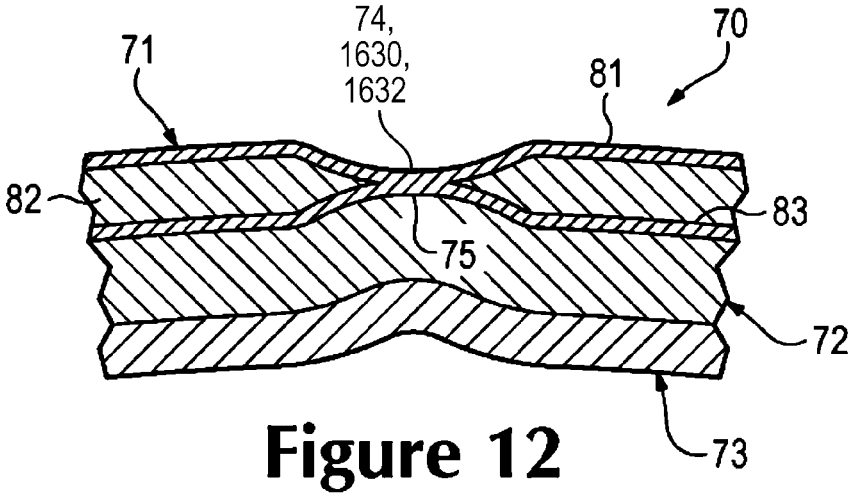
FIG. 12 is a cross-sectional view, as defined by section line 12 in FIG. 11.

Another sport ball 70 is depicted in FIGS. 11 and 12 as including a casing 71, an intermediate structure 72, and a bladder 73. As with panels 21 of casing 20, casing 71 has a layered configuration that includes an outer layer 81, a middle layer 82, and an inner layer 83. Additionally, layers 81 and 83 respectively form indentations 74 and 75 in areas of casing 71. Whereas casing 20 included various panels 21 that were joined by seams 22, casing 71 has a substantially uniform or unbroken configuration that does not include panels or includes fewer panels. In order to impart the appearance of seams similar to seams 22, however, indentations 74 and 75 are located in areas that correspond with the positions of seams 22 in ball 10. That is, indentations 74 and 75 impart the appearance of seams in ball 70.

In some embodiments, indentations in adjacent panels may be arranged to correspond with one another across the seams between the adjacent panels. In some embodiments, the indentations may extend proximate the seam on adjacent panels. In some cases, the indentations may extend to the edge of the panel, and thus continue across the seam. In some embodiments, the indentations of adjacent panels may be arranged to form a pattern, such as polygonal shapes. Further, the indentations may be arranged to continue a pattern of the seams between panels. For example, in some embodiments, the indentations may be aligned with seams. In some cases such indentations may be configured to define simulated panels of the casing. That is, by having the appearance of seams, indentations in the casing may be arranged to define portions of a panel that have the appearance of an entire panel. Further, in some embodiments, the indentations may be arranged in the pattern of a logo.

Figure 13:
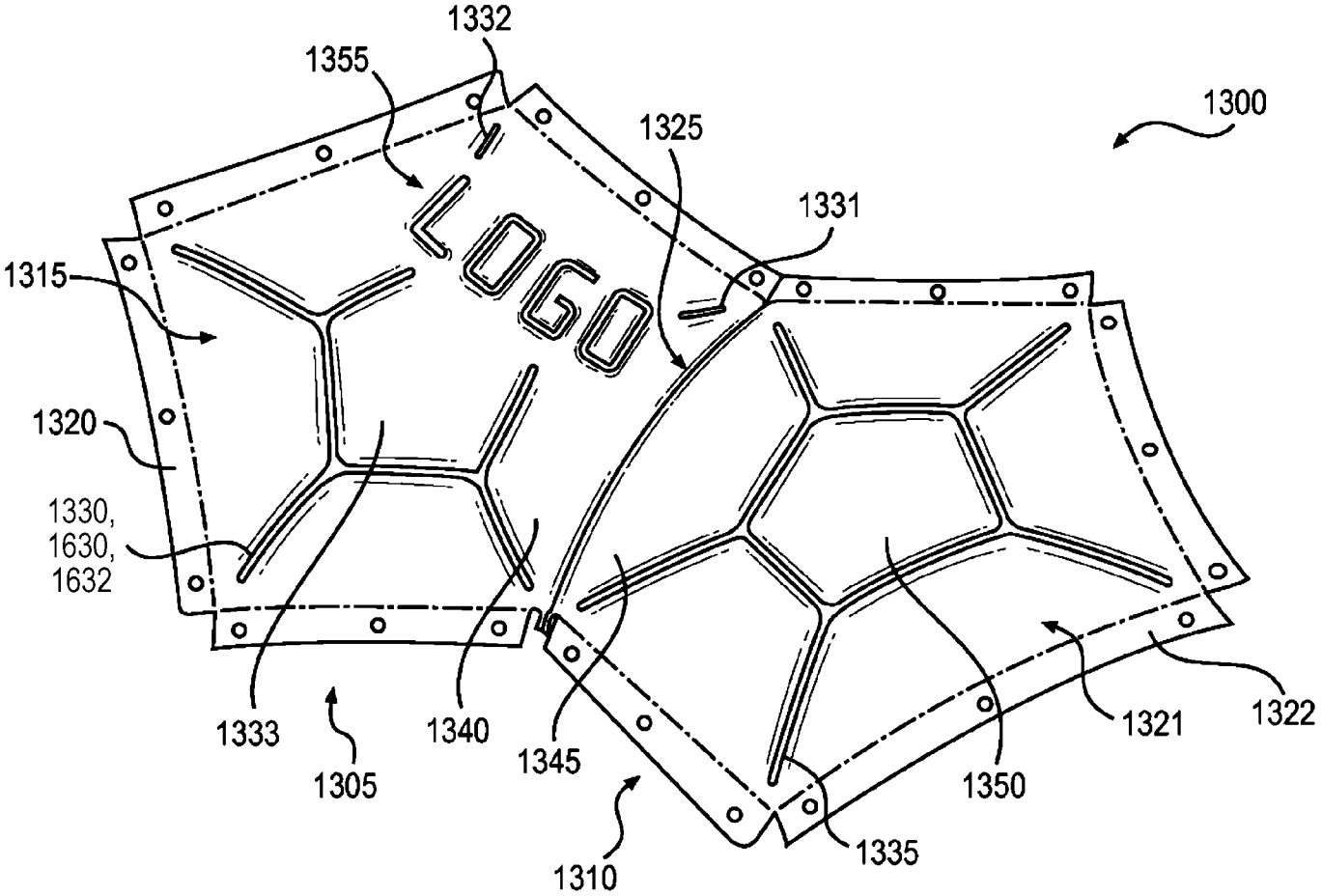
FIG. 13 is a schematic illustration of a portion of a casing, including two joined panels having indentations that form a pattern across the seam between the two panels.

FIG. 13 shows a portion of a sport ball casing 1300. Casing 1300 may be formed of a plurality of panels, including a first panel 1305 and a second panel 1310. First panel 1305 may be joined to second panel 1310 at a seam 1325. Seam 1325 may be formed using any suitable method of joining first panel 1305 and second panel 1310. Exemplary such methods include stitching, use of adhesives, and welding.

As shown in FIG. 13, first panel 1305 may include a first central panel portion 1315 and first flange areas 1320 at the peripheral edges of first panel 1305. Similarly, second panel may include a second central panel portion 1321 and second flange areas 1322. The flange areas may be joined to flange areas of other panels to form casing 1300 by forming seams, such as seam 1325.

First panel 1305 may include a first indentation 1330, a second indentation 1331, and a third indentation 1332. In some embodiments, first panel 1305 may include indentations arranged to form a logo 1355. Portions of first indentation 1330 may have an elongate configuration and may extend proximate to seam 1325. In some embodiments, first indentation 1330 may define a pattern that simulates seams of casing 1300. For example, in some cases, first indentation 1330 may include a plurality of elongate portions arranged to demarcate a first central simulated panel portion 1333, which may resemble a panel of casing 1300.

Second panel 1310 may include a fourth indentation 1335. Portions of fourth indentation 1335 may have an elongate configuration and may extend proximate to seam 1325. In addition, fourth indention 1335 may define a second central simulated panel portion 1350. First central simulated panel portion 1333 and second central simulated panel portion 1350 may have any suitable configurations. For example, as shown in FIG. 13, the central simulated panel portions may have a polygonal shape, such as a pentagonal shape, resembling a soccer ball panel.

In some embodiments, fourth indentation 1335 may be configured to correspond with first indentation 1330 and second indentation 1325 across seam 1325. Accordingly, first panel 1305 may also include a first mating panel portion 1340 defined by first indentation 1330 and second indentation 1331. Second panel 1310 may include a second mating panel portion 1345 defined by fourth indentation 1335. When first panel 1305 is joined to second panel 1310 at seam 1325, first mating panel portion 1340 may mate with second mating panel portion 1345 to form a pattern across seam 1325. For example, as shown in FIG. 13, first mating panel portion 1340 and second mating panel portion 1345 may combine to form a hexagonal casing portion that has the appearance of a hexagonal casing panel. In some embodiments, seam 1325 may include an indentation. In other embodiments, the exterior surface of casing 1300 may be substantially smooth across seam 1325.

In some embodiments, one or more of the indentations may continue a pattern formed by the plurality of seams joining panels of the casing. For example, as shown in FIG. 13, second indentation 1331 may be arranged in alignment with the edge of second panel 1310 and, therefore, may continue the pattern of a seam formed between second panel 1310 and an adjacent panel (not shown).

Figure 14:
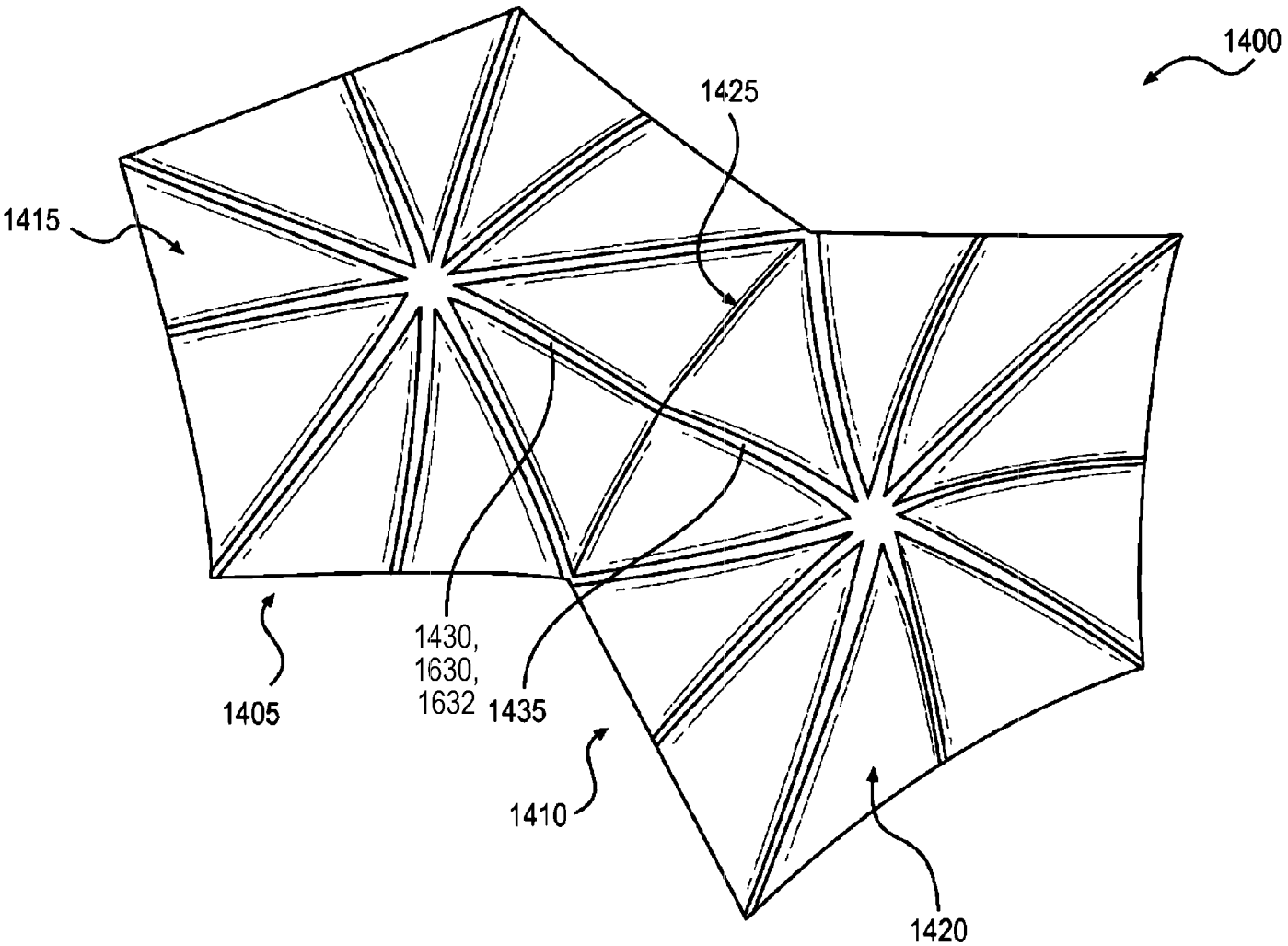
FIG. 14 is a schematic illustration of a portion of a casing, including two joined panels having indentations having the configuration shown in FIG. 7D.

FIG. 14 shows portions of a casing 1400, including a first panel 1405 and a second panel 1410, which may be joined to first panel 1405 at a seam 1425. First panel may include a first exterior surface 1415 and second panel 1410 may include a second exterior surface 1420. First panel 1405 and second panel 1410 may include indentations in first exterior surface 1415 and second exterior surface 1420, in which the indentations are arranged in the pattern shown in FIG. 7D. As shown in FIG. 14, first panel 1405 may include a first indentation 1430, and second panel 1410 may include a second indentation 1435. The indentations of first panel 1405 and second panel 1410 may have any of the configurations described above with respect to other disclosed embodiments.

In some embodiments, first indentation 1430 and second indentation 1435 may be arranged to form a pattern extending across seam 1425. For example, as shown in FIG. 14, in some embodiments, first indentation 1430 and second indentation 1435 may each have an elongate configuration. As further shown in FIG. 14, first indentation 1430 and second indentation 1435 may be in substantial alignment with one another across seam 1425.

Additional Sport Ball Configuration

Figure 15:
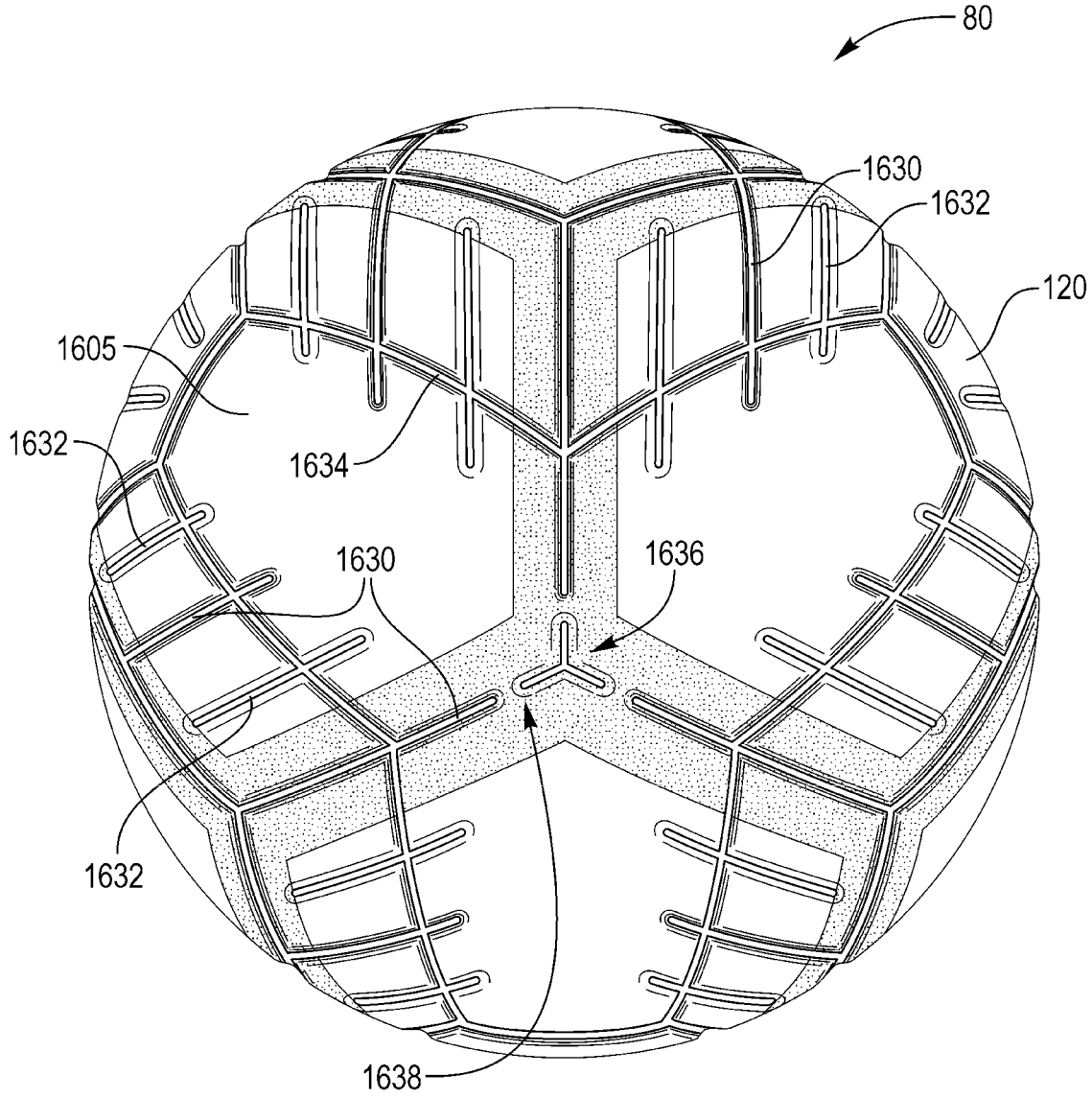
FIG. 15 is a schematic illustration of a perspective view of another embodiment of the sport ball of FIGS. 1 and 2.
Figure 16:
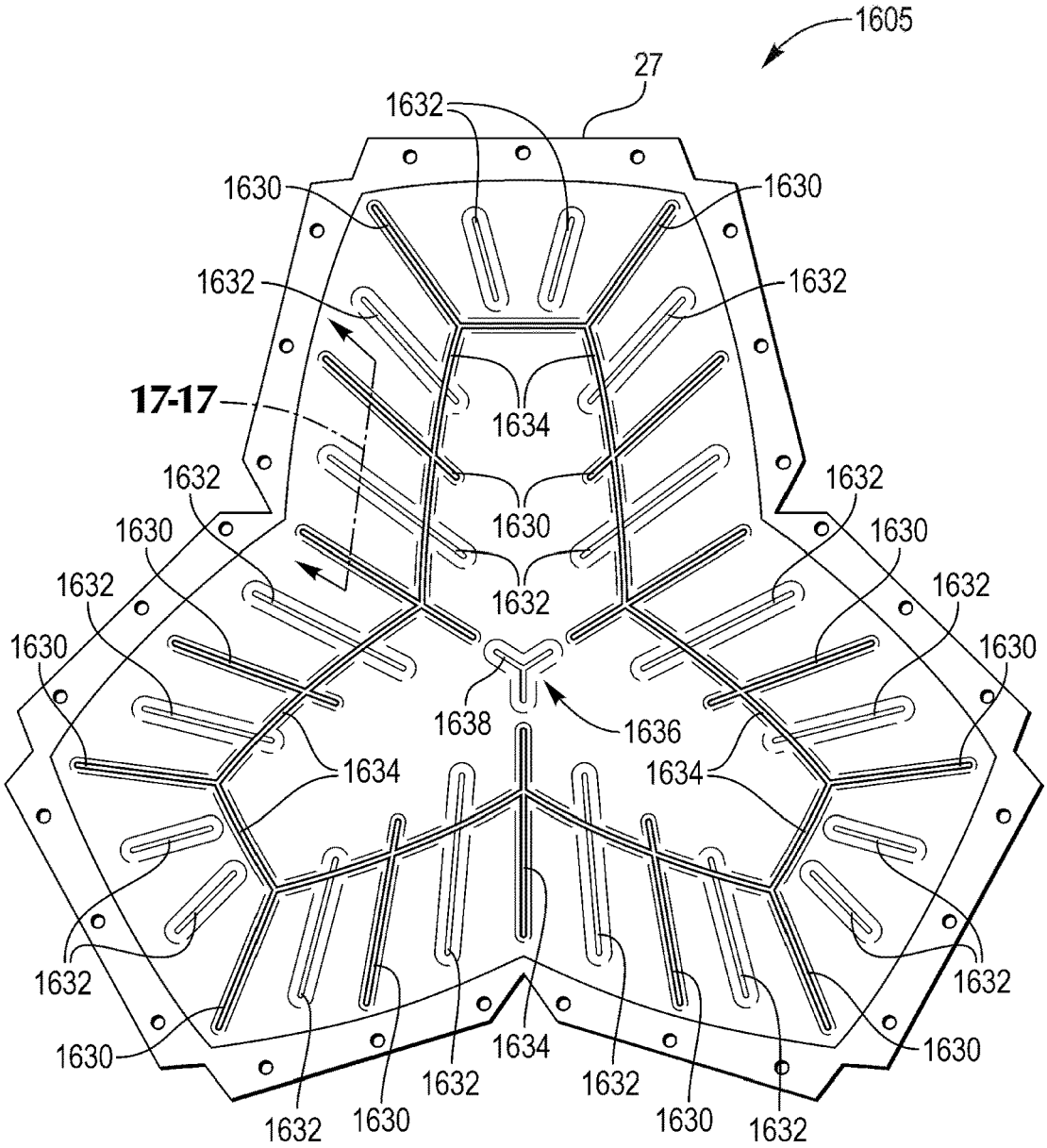
FIG. 16 is a schematic illustration of a plan view of a first panel of the sport ball of FIG. 1.

Referring now to FIGS. 15 and 16, in one embodiment of the sport ball 80, the casing 120 includes four joined panels 1605. That is, as shown in FIG. 16, the first panel 1605 may have nine edges 27 and may have a generally triangular shape that is formed from three pentagons. As such, the casing 120 may include four joined panels 1605 each having nine edges 27. Such a reduced number of joined panels 1605, e.g., four, may contribute to economical material usage during manufacturing of the sport ball 80.

Figure 17:
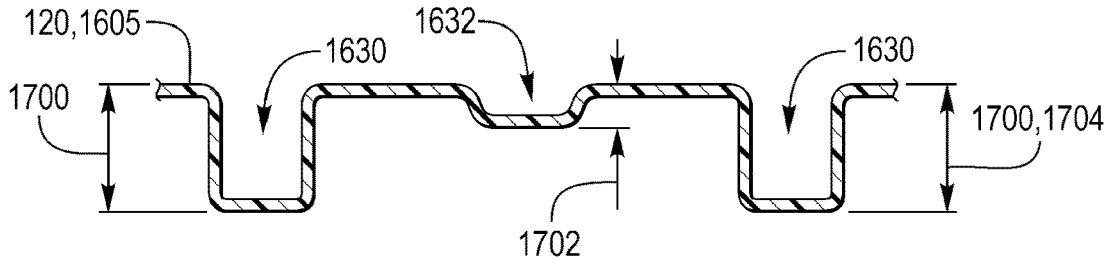
FIG. 17 is a schematic illustration of a cross-sectional view of the first panel of FIG. 16, taken along section line 17-17.

As shown in FIGS. 15 and 16, the first panel 1605 defines a first indentation 1630 and a second indentation 1632 spaced apart from the first indentation 1630. Further, as best shown in FIG. 17, the first indentation 1630 has a first depth 1700 and the second indentation has a second depth 1702 that is less than the first depth 1700. That is, the first panel 1605 may define a comparatively deeper first indentation 1630 or major channel and a comparatively shallower second indentation 1632 or minor channel. As a non-limiting example, the first depth 1700 may be from about 0.5 times to about 4 times larger than the second depth 1702. Without intending to be limited by theory, the sport ball 80 defining the first indentation 1630 and the second indentation 1632 may optimize flight characteristics, e.g., distance and height, when the sport ball 80 is struck during play, regardless of whether the sport ball 80 is struck with the valve disposed perpendicular or parallel to a ground surface. That is, the first indentation 1630 and the second indentation 1632 may neutralize any differences in flight distance and height that may be ordinarily dependent upon valve orientation before strike.

With continued reference to FIGS. 15-17, the first panel 1605 may further define a third indentation 1634 that intersects the second indentation 1632. As best shown in FIG. 16, the third indentation 1634 may also intersect the first indentation 1630. The third indentation 1634 may have a third depth 1704 that is equal to the first depth 1700.

Referring now to FIG. 16, in one embodiment, the first panel 1605 defines a plurality of first indentations 1630 and a plurality of second indentations 1632 each spaced apart from at least one of the plurality of first indentations 1630. As best shown in FIG. 17, each of the plurality of first indentations 1630 has the first depth 1700 and each of the plurality of second indentations 1632 has the second depth 1702 that is less than the first depth 1700.

Referring again to FIG. 16, each of the plurality of first indentations 1630 may be substantially parallel to at least another of the plurality of first indentations 1630. Similarly, each of the plurality of second indentations 1632 may be substantially parallel to at least another of the plurality of second indentations 1632. That is, the first panel 1605 may define the plurality of first indentations 1630 and the plurality of second indentations 1632 that are configured or arranged to form a pattern of channels in the casing 120. In one non-limiting example, one of the plurality of second indentations 1632 may be disposed between two adjacent ones of the plurality of first indentations 1630. That is, the plurality of first indentations 1630 and the plurality of second indentations 1632 may be disposed in an alternating arrangement, e.g., along the third indentation 1634. More specifically, by interleaving the shallower plurality of second indentations 1632 between adjacent ones of the deeper plurality of first indentations 1630, a sport ball design may be created that may reduce any orientation-dependent differences in flight distance and maximum height.

In one embodiment, the first panel 1605 may define a greater number of the plurality of first indentations 1630 than the plurality of second indentations 1632. Alternatively, the first panel 1605 may define a greater number of the plurality of second indentations 1632 than the plurality of first indentations 1630. The number and position of the plurality of first indentations 1630 and the plurality of second indentations 1632 may be selected according to desired flight characteristics of the sport ball 80.

Figure 18:
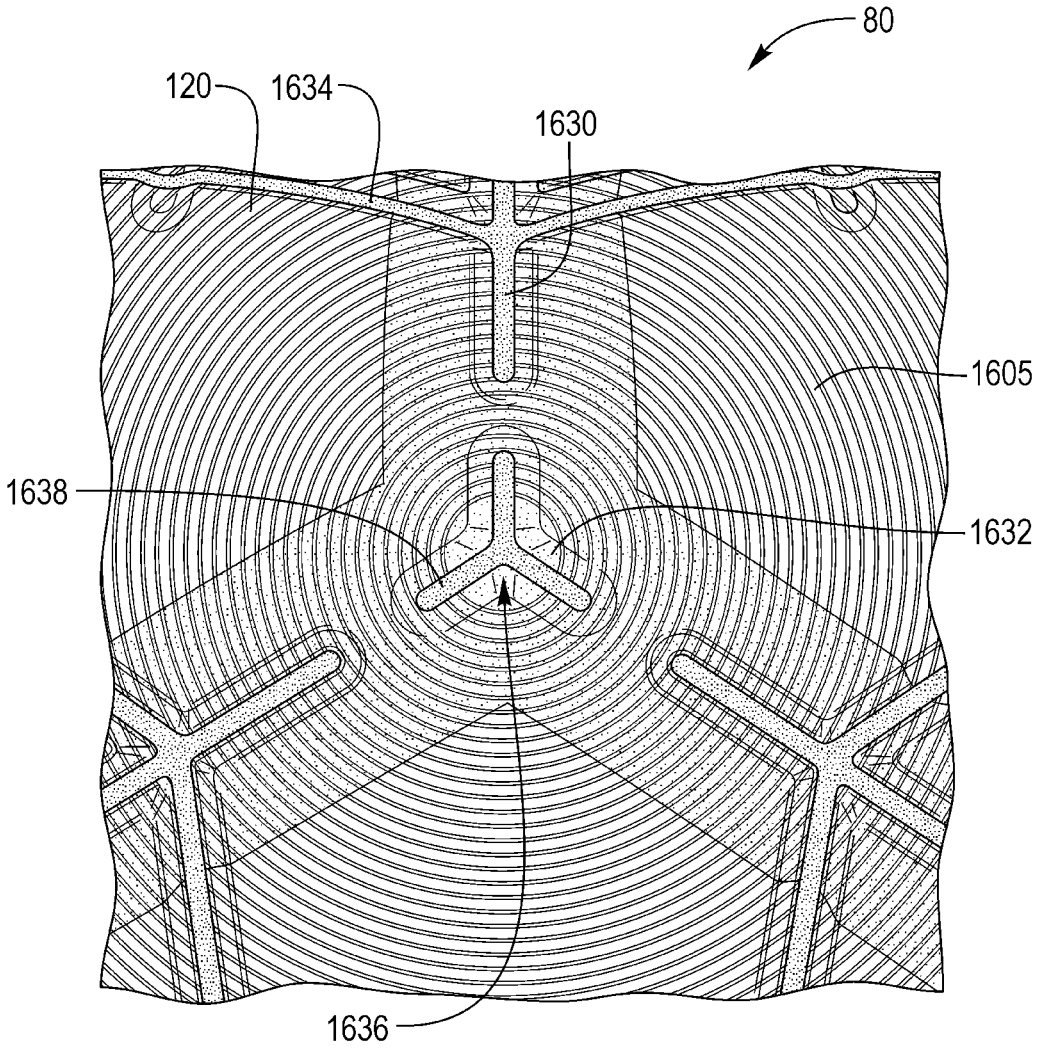
FIG. 18 is a schematic illustration of a perspective view of a portion of the sport ball of FIG. 15.

With continued reference to FIG. 16, the first panel 1605 may have a central portion 1636 and each of the plurality of first indentations 1630 may extend radially from the central portion 1636. Additionally or alternatively, each of the plurality of second indentations 1632 may extend radially from the central portion 1636. Further, as best shown in FIGS. 16 and 18, in one embodiment, one of the plurality of second indentations 1632 has three prongs 1638 that each extend from the central portion 1636.

Referring again to FIGS. 6, 8A, 8B, and 8D, the first layer 51 may be bonded directly to the third layer 53 at the first indentation 1630. Similarly, the first layer 51 may be bonded directly to the third layer 53 at the second indentation 1632. Alternatively, as shown in FIG. 8C, the first layer 51 may be spaced apart from the third layer 53 at at least one of the first indentation 1630 and the second indentation 1632.

Further, referring to FIGS. 8B, 8E, and 8F, the first panel 1605 may have a thickness 1644 and the first layer 51 may extend through an entirety of the thickness 1644 at the first indentation 1630 and the second indentation 1632. Alternatively, as shown in FIGS. 8A, 8C, and 8D, the first layer 51 may extend to an approximate midpoint 1646 of the thickness 1644 at the first indentation 1630 and the second indentation 1632.

Referring again to FIGS. 7C, 7E, and 7F, the first panel 1605 may have an edge 27 and at least one of the first indentation 1630 and the second indentation 1632 may be spaced apart from the edge 27. Alternatively, as shown in FIG. 7D, at least one of the first indentation 1630 and the second indentation 1632 may extend to the edge 27.

Referring now to FIG. 8E, at least one of the first indentation 1630 and the second indentation 1632 may have a substantially square cross-sectional configuration. In another embodiment, as shown in FIG. 8F, at least one of the first indentation 1630 and the second indentation 1632 has a rounded cross-sectional configuration. For example, the first indentation 1630 may have a first shoulder 1648 and a second shoulder 1650 each having a substantially rounded shape. Likewise, the second indentation 1632 may have a third shoulder 1652 and a fourth shoulder 1654 each having a substantially rounded shape.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The following examples are meant to illustrate the disclosure and are not to be viewed in any way as limiting to the scope of the disclosure.

EXAMPLES

Example 1

The sport ball of Example 1 includes a casing that includes a first panel that defines a plurality of first indentations and a plurality of second indentations. Each of the plurality of first indentations has a first depth and each of the plurality of second indentations has a second depth that is less than the first depth. One of the plurality of second indentations is disposed at a central portion of the first panel and has three prongs each extending from the central portion. Further, the casing of the sport ball of Example 1 defines a third indentation that intersects each of the first indentation and the second indentation. The third indentation has a third depth that is equal to the first depth.

Comparative Example 2

The sport ball of Comparative Example 2 includes a comparative casing that includes a panel that defines a plurality of first indentations and a third indentation that intersects each of the plurality of first indentations. Each of the plurality of first indentations and the third indentation have the first depth. The comparative casing does not define a second indentation.

The sport balls of Example 1 and Comparative Example 2 are struck by a mechanical device including a straight arm and an angled plate to induce flight from a ground surface into conditions of an average head wind of 3.58 m/s. Each sport ball is struck twice. For the first strike, each sport ball is oriented such that the valve is disposed perpendicular to the ground surface. For the second strike, each sport ball is oriented such that the valve is disposed parallel to the ground surface and 90° apart from a strike zone. That is, for the second strike, the valve is located on a side of the sport ball. The sport balls are evaluated for mass, sphericity, circumference, and first rebound height after being dropped as listed in Table 1. The sport balls are further evaluated for initial velocity immediately following a strike by the mechanical device, maximum height during flight, velocity upon landing, time of flight, and flight distance as listed in Table 2.

TABLE 1

Sport Ball Characteristics Before Strike

| Sport Ball | Ex. 1 | Comp. Ex. 2 |
|---|---|---|
| Mass (g) | 437.4 | 437.2 |
| Sphericity (%) | 1.3 | 1.2 |
| Circumference (mm) | 685.7 | 685.8 |
| Rebound Height (cm) | 138.3 | 137.7 |

TABLE 2

Flight Characteristics of the Sport Balls of Example 1 and Comparative Example 2

| Sport Ball - Valve Orientation | Initial Velocity (m/s) | Maximum Flight Height (meters) | Landing Velocity (m/s) | Time of Flight (sec) | Flight Distance (meters) |
|---|---|---|---|---|---|
| Comp. Ex. 2 - Perpendicular | 23.96 | 3.38 | 13.55 | 2.3 | 35.39 |
| Comp. Ex. 2 - Parallel + 90° | 24.14 | 3.75 | 13.50 | 2.4 | 37.22 |
| Comp. Ex. 2 Difference | 0.18 | 0.37 | −0.05 | 0.1 | 1.83 |
| Ex. 1 - Perpendicular | 23.78 | 3.75 | 13.32 | 2.4 | 36.94 |
| Ex. 1 - Parallel + 90° | 24.23 | 3.75 | 13.37 | 2.4 | 36.76 |
| Ex. 1 Difference | 0.45 | 0 | 0.05 | 0 | −0.21 |

As shown in Table 2, the flight distance of the sport ball of Example 1, which includes a casing that defines the first indentation and the second indentation, is substantially the same regardless of whether the valve is disposed perpendicular or parallel to the ground surface before strike. Similarly, the maximum flight height of the sport ball of Example 1 is the substantially the same regardless of whether the valve is disposed perpendicular or parallel to the ground surface before strike. In contrast, the flight distance of the sport ball of Comparative Example 2, which includes a comparative casing that defines only the first indentation and does not define the second indentation, varies depending upon whether the valve is disposed perpendicular or parallel to the ground surface before strike. In addition, the maximum flight height of the sport ball of Comparative Example 2 varies depending upon whether the valve is disposed perpendicular or parallel to the ground surface before strike. As such, the plurality of first indentations and the plurality of second indentations defined by the sport ball of Example 1 neutralize differences in flight distance and maximum height that are ordinarily dependent upon valve orientation before strike.

The invention claimed is:

1. A sport ball comprising:

a casing that includes a plurality of joined panels and defines a cavity, wherein the casing includes at least a first panel having (a) a first layer formed from a polymer material and positioned to form a portion of an exterior surface of the sport ball, (b) a second layer formed from a polymer foam material and disposed adjacent to the first layer, and (c) a third layer formed from a textile material and disposed adjacent to the second layer; and a bladder disposed within the cavity;

wherein the first panel defines:

a plurality of first indentations in the exterior surface; and a plurality of second indentations in the exterior surface that are each spaced apart from at least one of the plurality of first indentations; and a third indentation in the exterior surface that intersects at least one of the plurality of first indentations and at least one of the plurality of second indentations;

wherein each of the plurality of first indentations is parallel to at least another of the plurality of first indentations;

wherein one of the plurality of second indentations is disposed between two adjacent ones of the plurality of first indentations such that the plurality of first indentations and the plurality of second indentations are disposed in an alternating arrangement;

wherein each of the plurality of first indentations has a first depth;

wherein each of the plurality of second indentations has a second depth that is less than the first depth;

wherein the third indentation has a third depth that is equal to the first depth; and wherein the first depth is from 0.5 times to 4 times larger than the second depth.

2. The sport ball of claim 1, wherein the first panel defines a greater number of the plurality of second indentations than the plurality of first indentations.

3. The sport ball of claim 1, wherein the first panel has a central portion and each of the plurality of second indentations extends radially from the central portion.

4. The sport ball of claim 3, wherein one of the plurality of second indentations has three prongs that each extend from the central portion.

5. The sport ball of claim 1, wherein at least one of the polymer material of the first layer and the polymer foam material of the second layer includes a thermoplastic polymer material.

6. The sport ball of claim 1, wherein the casing includes four joined panels each having nine edges.

7. The sport ball of claim 1, wherein the first layer is bonded directly to the third layer at at least one of the plurality of first indentations or at least one of the plurality of second indentations.

8. The sport ball of claim 1, wherein the first layer is spaced apart from the third layer at at least one of the plurality of first indentations or at least one of the plurality of second indentations.

9. The sport ball of claim 1, wherein the first panel has an edge and at least one of the plurality of first indentations or at least one of the plurality of second indentations is spaced apart from the edge.

10. The sport ball of claim 1, wherein the first panel has an edge and at least one of the plurality of first indentations or at least one of the plurality of second indentations extends to the edge.

11. The sport ball of claim 1, wherein at least one of the plurality of first indentations or at least one of the plurality of second indentations has a square cross-sectional configuration.

12. The sport ball of claim 1, wherein at least one of the plurality of first indentations or at least one of the plurality of second indentations has a rounded cross-sectional configuration.

13. The sport ball of claim 1, wherein the first panel has a thickness and the first layer extends through an entirety of the thickness at each of the plurality of first indentations and each of the plurality of second indentations.

14. The sport ball of claim 1, wherein the first panel has a thickness and the first layer extends to a midpoint of the thickness at each of the plurality of first indentations and each of the plurality of second indentations.

* * * * *